US007161551B2

(12) United States Patent
Sano

(10) Patent No.: US 7,161,551 B2
(45) Date of Patent: Jan. 9, 2007

(54) ANTENNA AND WRISTWATCH

(75) Inventor: Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 57 days.

(21) Appl. No.: 10/956,646

(22) Filed: Oct. 1, 2004

(65) Prior Publication Data

US 2005/0078045 A1 Apr. 14, 2005

(30) Foreign Application Priority Data

Oct. 9, 2003 (JP) ..... 2003-350733
Nov. 19, 2003 (JP) ..... 2003-389393

(51) Int. Cl.
*H01Q 7/08* (2006.01)

(52) U.S. Cl. ..... 343/788; 343/787

(58) Field of Classification Search ..... 343/787, 343/788

See application file for complete search history.

(56) References Cited

U.S. PATENT DOCUMENTS 3,750,180 A * 7/1973 Fujimoto et al. ..... 343/788
6,014,111 A 1/2000 Johannessen
6,897,827 B1 * 5/2005 Senba et al. ..... 343/873
6,927,738 B1 * 8/2005 Senba et al. ..... 343/787
6,987,490 B1 * 1/2006 Sano ..... 343/788

FOREIGN PATENT DOCUMENTS

DE 44 07 116 A 9/1995
DE 296 07 866 U 8/1997
EP 0 348 636 A 1/1990
EP 1 043 638 A 10/2000

OTHER PUBLICATIONS

Patent Abstracts of Japan, vol. 0041, No. 37 (-027), Sep. 25, 1980 and JP 55-091237 A (SEIKO EPSON CORP.), Jul. 10, 1980—Abstract.

* cited by examiner

*Primary Examiner*—Tho Phan
(74) *Attorney, Agent, or Firm*—Frishauf, Holtz, Goodman & Chick, P.C.

(57) ABSTRACT

An antenna has: a core; a coil which is wound on the core; and a magnetic body layer to cover both end portions of the coil and a peripheral portion of the core other than a portion of the core on which the coil is wound.

5 Claims, 27 Drawing Sheets

ANTENNA AND WRISTWATCH

BACKGROUND OF THE INVENTION

1. Field of the Invention

The present invention relates to an antenna and a wristwatch provided with the antenna.

2. Description of Related Art

Currently, a long-wave standard radio wave including the time data or the time code is transmitted in countries (for example, Germany, England, Switzerland, Japan and the like). In Japan, the long-wave standard radio waves of 40 kHz and 60 kHz that are subjected to amplitude modulation by the time code in a predetermined format are transmitted from two transmitting stations (in Hukushima prefecture and Saga prefecture). The time code having a frame with a period of 60 seconds is transmitted every time a minute digit of the correct time is updated, that is, every one minute.

Recently, a watch so-called a radio watch which corrects the current time data by receiving the standard radio wave including such time code has been put to practical use. The radio watch receives the standard radio wave through an antenna which is stored in the radio watch every predetermined time, amplifying and modulating it to decode the time code, and corrects the current time of the radio watch.

As the receiving antenna stored in the radio watch, a bar antenna is generally used. An earlier developed antenna comprises a bar-shaped core which is formed with a magnetic body such as ferrite, amorphous or the like, and a coil which is formed by winding a lead wire such as copper wire or the like around the core.

When the antenna is placed in a magnetic field by the standard radio wave (hereinafter, referred to as a "signal magnetic field"), the magnetic field acts on the antenna as follows. The standard radio wave is an alternating radio wave, so that the segments of the magnetic field is an alternating magnetic field in which the strength or the direction periodically changes.

When the core is placed to make an axis line thereof be parallel to the direction of the magnetic field in the signal magnetic field, a magnetic flux (hereinafter, referred to as a "signal magnetic flux") by the signal magnetic field is concentrated into the core having a high permeability compared to the surrounding space.

When alternating-current power is applied to the coil of the antenna, a magnetic flux which corresponds to the time change of the alternating current flowing in the coil (that is, direction and strength change) is generated.

Accordingly, when the antenna is placed in the signal magnetic field, the signal magnetic flux is concentrated in the core to pass the coil, and an induced electromotive force V is generated in the coil to generate a magnetic flux (hereinafter, referred to as a "generated magnetic flux") that opposes the change of the signal magnetic flux in the coil according to Lenz's law. The signal magnetic field is the alternating magnetic field, so that the strength or the direction of the signal magnetic field periodically changes. Accordingly, the induced electromotive force becomes alternating-current power, and the generated magnetic flux becomes an alternating magnetic field which periodically changes the strength or the direction corresponding to the time change of the signal magnetic flux.

The induced electromotive force V generated in the coil is detected by a receiving circuit connected to the coil. The receiving circuit comprises a tuning capacitor Cress and a loss resistance Ra for tuning to the frequency of the standard radio wave desire to receive (40 kHz or 60 kHz).

In the earlier developed antenna (bar antenna) having such structure, the receiver sensitivity of the standard radio wave depends upon the strength of the magnetic field in the coil (that is, magnetic flux density). Therefore, there has been known the antenna in which the sectional area of both end portions of the core (magnetic body) is increased to trap more magnetic flux, thereby improving the receiver sensitivity by making more signal magnetic flux pass through the coil.

However, in the above described earlier developed antenna, it is not avoided to cause loss by the signal magnetic flux.

(1) When a part of the signal magnetic flux passes (crosses) the both end portions of the coil, loss by the signal magnetic flux may be caused.

(2) When a part of the signal magnetic flux passes through the outside of the coil, loss by the signal magnetic flux may be caused or the receiving efficiency may decrease.

(3) When there is a metal near the antenna, in a space including a portion of the metal, loss is caused because a part of the generated magnetic flux passes the metal. That is, when a part of the generated magnetic flux passes the metal, eddy current flows in the metal, so that eddy current loss may be generated. It is considered that the coil and the metal are magnetically coupled with a predetermined coupling coefficient k, and a part of the generated power in the coil (induced electromotive force V) is consumed in the metal, so that the receiver sensitivity of the antenna is reduced.

SUMMARY OF THE INVENTION

The present invention is developed in view of the above described problems, and an object of the present invention is to provide an antenna (particularly, bar-antenna) in which a loss generated in the antenna by a signal magnetic flux can be reduced as little as possible to improve a receiver sensitivity of the radio wave.

The present invention is to achieve the above objects.

In accordance with a first aspect of the present invention, the antenna comprises:

a core;

a coil which is wound on the core; and a magnetic body layer to cover both end portions of the coil and a peripheral portion of the core other than a portion of the core on which the coil is wound.

In accordance with a second aspect of the present invention, the antenna comprises:

a bar shaped core;

a coil which is wound on an outer periphery of the core at a middle portion;

two covering parts made of a magnetic material to cover the outer periphery of the core at both end portions; and circular shaped spaces which are formed in facing surfaces of the two covering cores, each of the circular shaped spaces being formed between an inner periphery of each of the two covering cores and the outer periphery of the core, wherein both end portions of the coil are inserted and arranged inside the circular shaped spaces.

In accordance with a third aspect of the present invention, the antenna comprises:

a core; and a coil which is wound on the core, wherein the core is provided with two hook portions made of a material same as that of the core or a predetermined material on a peripheral surface, tip portions of the hook portions facing each other, and the coil is wound between the two hook portions.

In accordance with a fourth aspect of the present invention, the antenna comprises:

a core; and a coil which is wound on the core, wherein the core is provided with two projecting portions made of a material same as that of the core or a predetermined material on a peripheral surface, and the coil is wound between the two projecting portions.

In accordance with a fifth aspect of the present invention, the wristwatch comprises:

an antenna having a core, a coil which is wound on the core, and a magnetic body layer to cover both end portions of the core and a peripheral portion of the core other than a portion of the core on which the coil is wound;

a time code generating section to generate a standard time code based on a radio wave received by the antenna;

a time measuring section to measure a current time; and a correction section to correct the current time data which is measured by the time measuring section based on the standard time code generated by the time code generating section.

In accordance with a sixth aspect of the present invention, the antenna comprises:

a bar shaped core;

a coil which is wound on a middle portion of the core; and a plate shaped magnetic member which is arranged to face the core with a distance thereto along an axis direction of the core, wherein the magnetic member comprises a plurality of magnetic body pieces which are separated at a position facing a portion of the core on which the coil is wound.

In accordance with a seventh aspect of the present invention, the antenna comprises:

a bar shaped core;

a coil which is wound on a middle portion of the core; and a plate shaped magnetic member which is arranged to face the core with a distance thereto along an axis direction of the core, wherein the magnetic member is formed to have a length in a longitudinal direction smaller than a length of a portion of the core on which the coil is wound.

In accordance with an eighth aspect of the present invention, the antenna comprises:

a bar shaped core;

a coil which is wound on a middle portion of the core;

a plate shaped magnetic member which is arranged to face the core with a distance thereto along an axis direction of the core; and a fixing member to combine the core and the magnetic member.

In accordance with a ninth aspect of the present invention, the antenna comprises:

a bar shaped core;

a coil which is wound on a middle portion of the core;

a plurality of plate shaped magnetic members which are arranged to face the core with a distance thereto along an axis direction of the core; and a fixing member to combine the core and the plurality of magnetic members arranged in a circumferential direction of the core.

In accordance with a tenth aspect of the present invention, the radio watch comprises:

an antenna which comprises a bar shaped core, a coil which is wound on a middle portion of the core, and a plate shaped magnetic member which is arranged to face to the core with a distance thereto along an axis direction of the core, the magnetic member having a plurality of magnetic body pieces which are separated at a position facing a portion of the core on which the coil is wound; and a watch body in which the antenna is arranged.

BRIEF DESCRIPTION OF THE DRAWINGS

FIGS. 1A to 1D are views showing an antenna in the first embodiment of the present invention, wherein FIG. 1A is a front view of the antenna, FIG. 1B is a right side view of FIG. 1A, FIG. 1C is a sectional view on an arrow IC—IC in FIG. 1A, and FIG. 1D is a sectional view on an arrow ID—ID in FIG. 1A;

FIGS. 7A to 7E are views showing an antenna formed with amorphous in the first embodiment of the present invention, wherein FIG. 7A is a plan view of the antenna, FIG. 7B is a sectional view on an arrow VIIB—VIIB in FIG. 7A, FIG. 7C is a right side view of FIG. 7A, FIG. 7D is a horizontal sectional view of FIG. 7A, and FIG. 7E is a sectional view on an arrow VIIE—VIIE in FIG. 7A;

FIGS. 8A and 8B are views showing a combined type antenna formed with amorphous and ferrite in the first embodiment of the present invention, wherein FIG. 8A is a front view of the antenna formed with amorphous and ferrite, and FIG. 8B is a sectional view on an arrow VIIIB—VIIIB in FIG. 8A;

FIGS. 9A to 9D are views showing an antenna in which a covering core is provided with a cut portion in the first embodiment of the present invention, wherein FIG. 9A is a front view of the antenna, FIG. 9B is a right side view of FIG. 9A, FIG. 9C is a horizontal sectional view of FIG. 9A, and FIG. 9D is a sectional view on an arrow IXD—IXD in FIG. 9A;

FIGS. 10A to 10C are views showing an antenna in which facing surfaces of covering cores are formed to be inclined in the first embodiment of the present invention, wherein FIG. 10A is a front view of the antenna, FIG. 10B is a vertical sectional view of FIG. 10A, and FIG. 10C is a sectional view showing a watch device in which the antenna in FIG. 10A is stored;

FIGS. 11A and 11B are views showing an antenna in which a clearance is filled in with a nonmagnetic material in the first embodiment of the present invention, wherein FIG. 11A is a front view of the antenna, and FIG. 11B is a vertical sectional view of FIG. 11A;

FIGS. 12A and 12B are views showing an antenna in which end portions of a coil are not covered with covering cores in the first embodiment of the present invention, wherein FIG. 12A is a front view of the antenna, and FIG. 12B is a vertical sectional view of FIG. 12A;

PREFERRED EMBODIMENT OF THE INVENTION

Hereinafter, the preferred embodiments of the present invention will be described in detail by reference to the attached drawings. In each drawing, the diameter of a lead wire of a coil is increased and the number of turns of the coil is reduced, and a lead wire connecting the coil and a receiving circuit is omitted, to simplify the explanation. Moreover, explanations will be made of a case where the present invention is applied to an antenna for receiving radio wave which is stored in a radio watch, which is a wristwatch type. However, the present invention is not limited thereto.

[First Embodiment]

[Antenna]

Figure 1A:
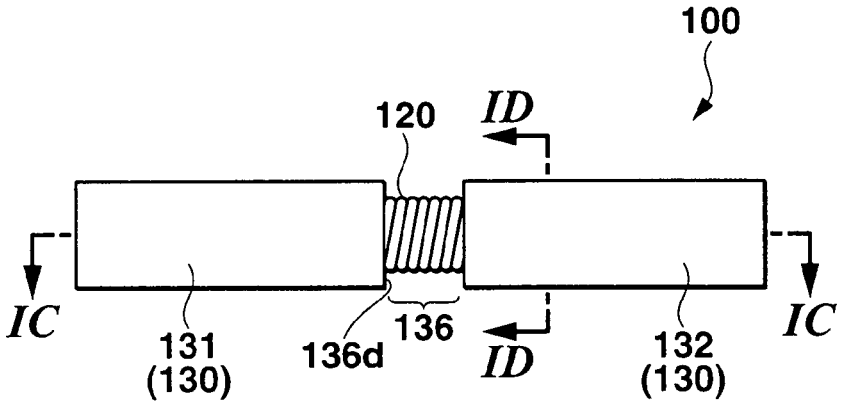
Figure 1B:
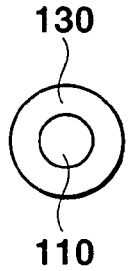
Figure 1C:
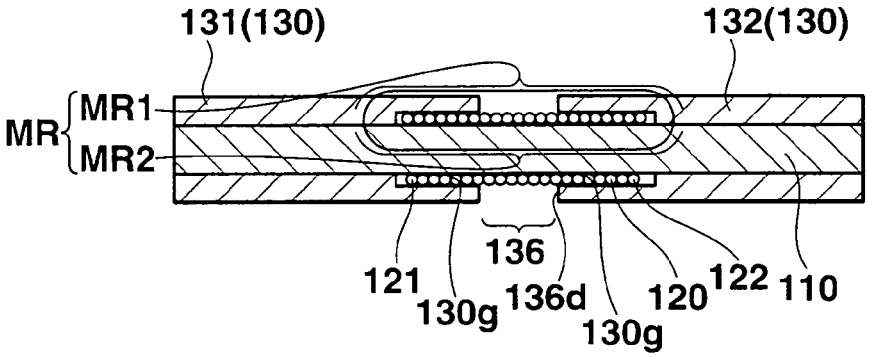
Figure 1D:
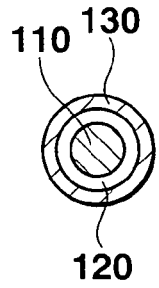

FIGS. 1A to 1D are views showing an antenna 100 in this embodiment. FIG. 1A is a front view of the antenna 100, FIG. 1B is a right side view of FIG. 1A, FIG. 1C is a sectional view on an arrow IC—IC in FIG. 1A, and FIG. 1D is a sectional view on an arrow ID—ID in FIG. 1A.

As shown in figures, the antenna 100 comprises a bar-shaped core 110, a coil 120 which is formed by winding a lead wire such as a copper or the like around the middle portion of the core 110, and covering cores 131 and 132 (hereinafter, generically referred to as "covering core 130") each covering one of both end portions of the coil 120.

The core 110 and the covering core 130 are formed with a magnetic material having a high relative permeability (for example about 1,000 to 100,000) and a high electric resistance such as ferrite, amorphous or the like. Thus, the magnetic resistance in the core 110 and the covering core 130 is extremely small compared to the magnetic resistance in a space around the antenna 100, that is, about 1/1,000 to 1/100,000 of the magnetic resistance in the space around the antenna 100.

Each of the covering cores 131 and 132 has an approximately cylindrical shape, and they are approximately the same shape. Each of the covering cores 131 and 132 is provided with a space 130*g* formed inside each of the end portions which face each other, and opening portions of the spaces 130*g* are formed to face each other. Each end portion of the coil 120 (about 1/3 of the length of the coil 120 in the axis direction in FIG. 1C) is stored in each space 130*g* of the covering cores 131 and 132 to cover both and portions of the covering cores 131 and 132.

The inner periphery of the covering core 130 contacts the outer periphery of the core 110 at a portion which does not cover the ends of the coil 120. Thus, the covering core 130 is combined with the core 110.

That is, the covering cores 131 and 132 are formed to be laminated on both end portions of the coil 120. The cores 131 and 132 may be formed by adhering and laminating magnetic thin films on the outer periphery of both end portions of the coil 120 and the core 110 to cover both end portions of the coil 120.

When viewing the shape of the whole antenna 100 excluding the coil 120, the middle portion of the outer periphery of the core 110 forms a recess, and each end portion of the outer periphery of the core 110 forms a projecting portion because the covering cores 131 and 132 cover both end portions. The coil 120 is wound at the recess provided between the covering cores 131 and 132 each of which is a projecting portion.

According to the antenna 100 formed as described above, the core 110 is magnetically coupled to each of the covering cores 131 and 132. However, the covering cores 131 and 132 are in a state of being magnetically separated at the outer periphery portion of the coil 120 by the clearance 136 formed therebetween. Accordingly, as shown in FIG. 1C, in magnetic routes MR surrounding the coil 120, the magnetic resistance of a route MR1 (outside route) passing the outside of the coil 120 through the clearance 136 is much larger than the magnetic resistance of a route MR2 (inside route) passing the inside of the coil 120 due to the clearance 136.

When the antenna 100 having such structure is placed, for example, in the signal magnetic field by the standard radio wave, this magnetic field acts on the antenna 100 as follows.

Figure 2:
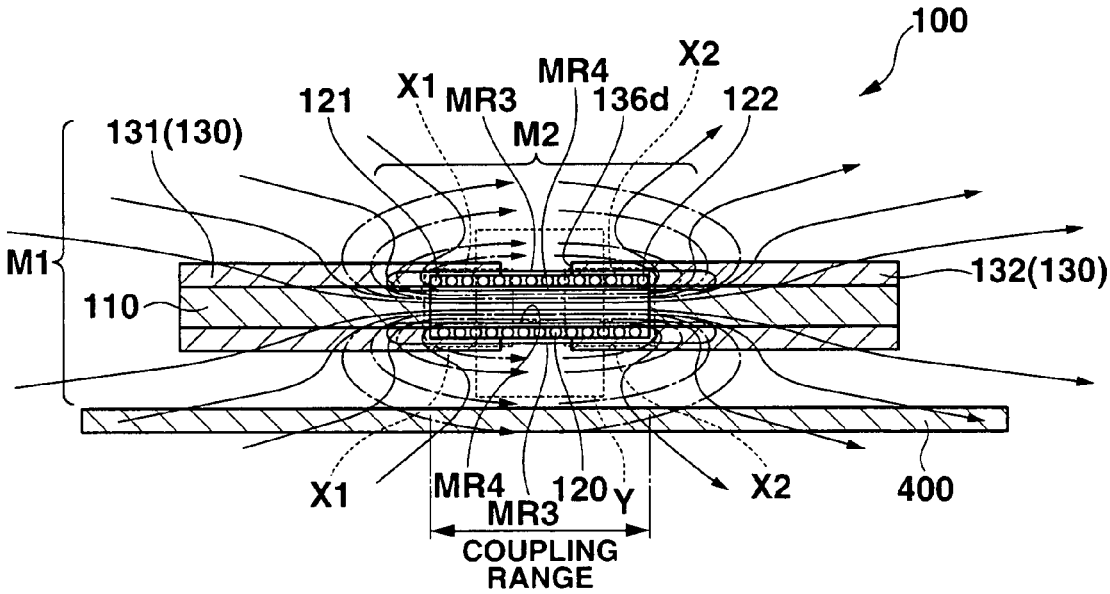
FIG. 2 is a view showing an action of a signal magnetic field on the antenna in the first embodiment of the present invention.

FIG. 2 is a vertical sectional view showing an action of the signal magnetic field on the antenna 100 by the standard radio wave. Hereupon, the signal magnetic field is a parallel magnetic field, and the antenna 100 is placed to make the axis line of the coil 120 be parallel to the direction of the magnetic field.

As shown in the figure, when the antenna 100 is placed in the signal magnetic field, a signal magnetic flux M1 (illustrated by solid lines in the figure) is concentrated in the core 110 and passes the coil 120, so that a generated magnetic flux M2 (illustrated by dashed lines in the figure) to oppose the change of the signal magnetic flux M1 passing the inside of the coil 120 is generated in the coil 120.

Specifically, the signal magnetic flux M1 is distributed as follows.

First, in a space X1 including one end portion 121 (entering side of the signal magnetic flux) of the coil 120, the signal magnetic flux M1 goes around the outside of the one end portion 121 (left side in the figure) to pass the covering core 131 covering the one end portion 121 and then enter the core 110 (inside of the core 110). In a space X2 including the other end portion 122 of the coil 120, the signal magnetic flux M1 which passed the covering core 131 and then entered the core 110 goes around the outside of the other end portion 122 (right side in the figure) to pass the covering core 132 covering the other end portion 122 from the core 110 and then go out to the space outside the antenna 100.

In the case of not comprising the covering core 131, the signal magnetic flux M1, for example as shown in chain double-dashed lines in the figure, passes the one end portion 121 of the coil 120 to enter the core 110 in the space X1, and then passes the other end portion 122 of the coil 120 from the core 110 in the space X2 to go out to the space outside the antenna 100. However, in the embodiment, the covering cores 131 and 132 are provided, so that the signal magnetic flux M1 enters the core 110 without passing the one end portion 121 of the coil 120 in the space X1, and then goes out to the space outside the antenna 100 without passing the other end portion 122 of the coil 120 in the space X2. Accordingly, an extremely large amount of signal magnetic flux M1 passes the coil 120 compared to the case where the covering cores 131 and 132 are not provided.

In a space Y near the center of the coil 120, when comparing the magnetic resistance of an outside route MR3 passing the clearance 136 and the outside of the coil 120 with the magnetic resistance of an inside route MR4 passing the inside of the coil 120, the magnetic resistance of the outside route MR3 is much larger than that of the inside route MR4 due to the clearance 136. Thus, the signal magnetic flux M1 does not pass the outside of the coil 120, but passes the route to enter the core 110 by passing the covering core 131 and pass the covering core 132 from the core 110. At this time, the signal magnetic flux M1 does not pass the each end portion 121 and 122 of the coil 120, and goes around the outside of each end portion 121 and 122 passes the covering core 130.

The generated magnetic flux M2 is distributed as follows.

In the outside portion of the coil 120 in FIG. 2, the generated magnetic flux M2 takes the route to pass the covering core 130 which has the magnetic resistance smaller than the space around the antenna 100. When passing the covering core 130, the generated magnetic flux M2 goes around the outside of each end portion 121 and 122 of the coil 120 to pass the covering core 130 similar to the above described signal magnetic flux M1. Thus, the generated magnetic flux M2 concentrates at the outer peripheral portion of each of the end portions 121 and 122 of the coil 120 to have the largest magnetic flux density (magnetic field is strong). However, the magnetic flux density is small (magnetic field becomes weak) as the generated magnetic flux M2 gets away from the coil 120 in the outer peripheral direction thereof.

Figure 3:
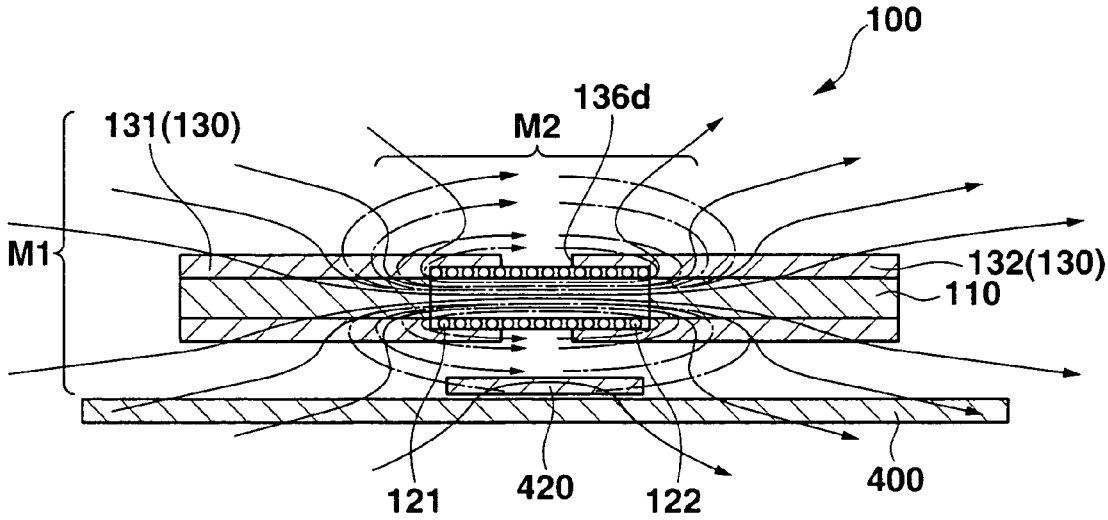
FIG. 3 is a view showing an embodiment when a magnetic body is placed between the antenna and the metal of the first embodiment of the present invention.

FIG. 3 is a view showing another embodiment in which a magnetic body 420 is placed to suppress eddy current loss in the metal 400 arranged to be parallel to the axis of the antenna 100.

As in this example, when the magnetic body 420 is placed to suppress the eddy current loss as shown in FIG. 3, the signal magnetic flux M1 passes the magnetic body 420 without passing the metal 400, so that the eddy current loss can effectively be suppressed, thereby decreasing loss.

[Wristwatch storing Antenna]

Next, an explanation will be made of an example in which the antenna 100 in this embodiment is stored in a radio watch.

Figure 4:
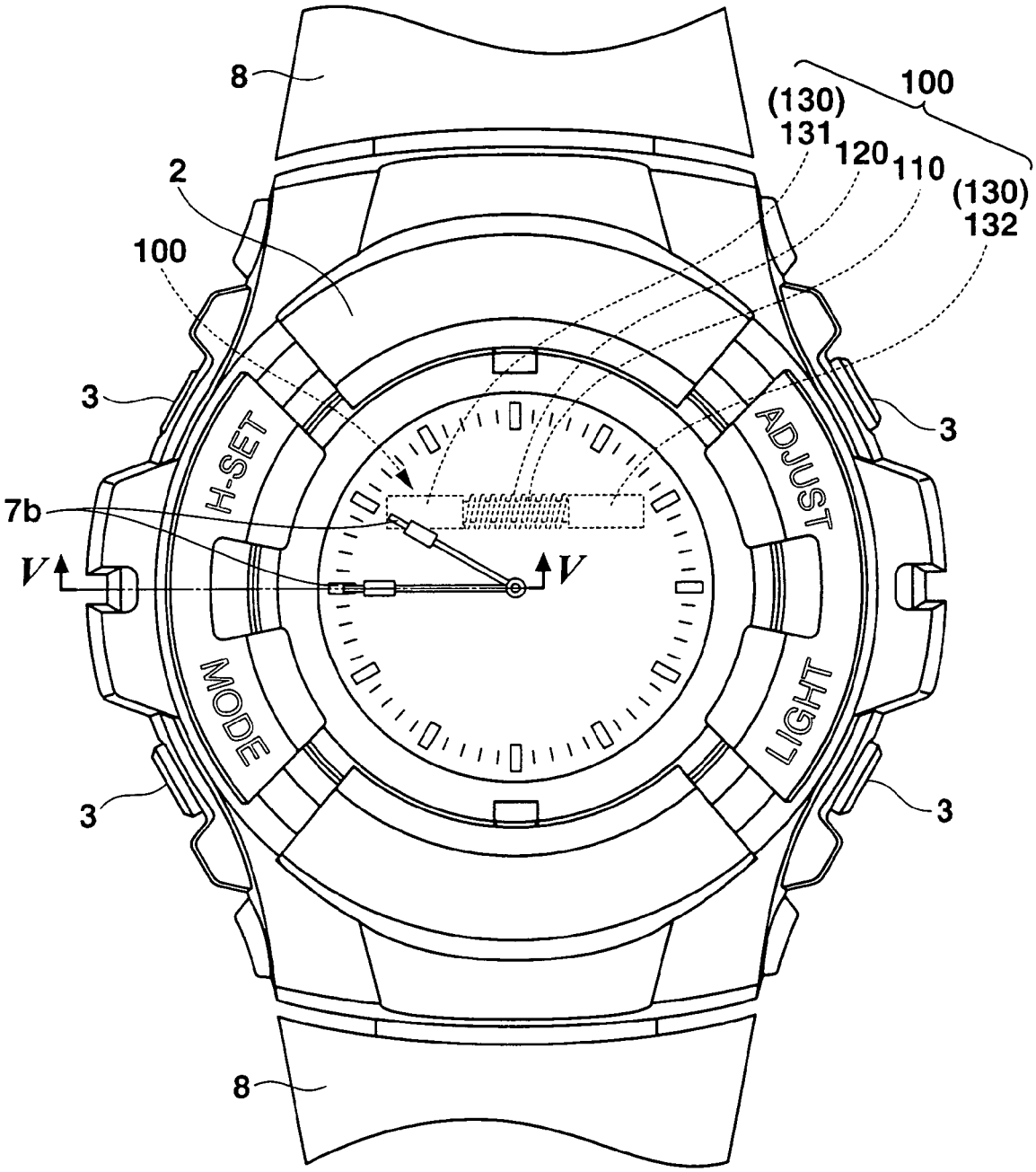
FIG. 4 is a plan view of a wristwatch in which the antenna of the first embodiment of the present invention is stored.
Figure 5:
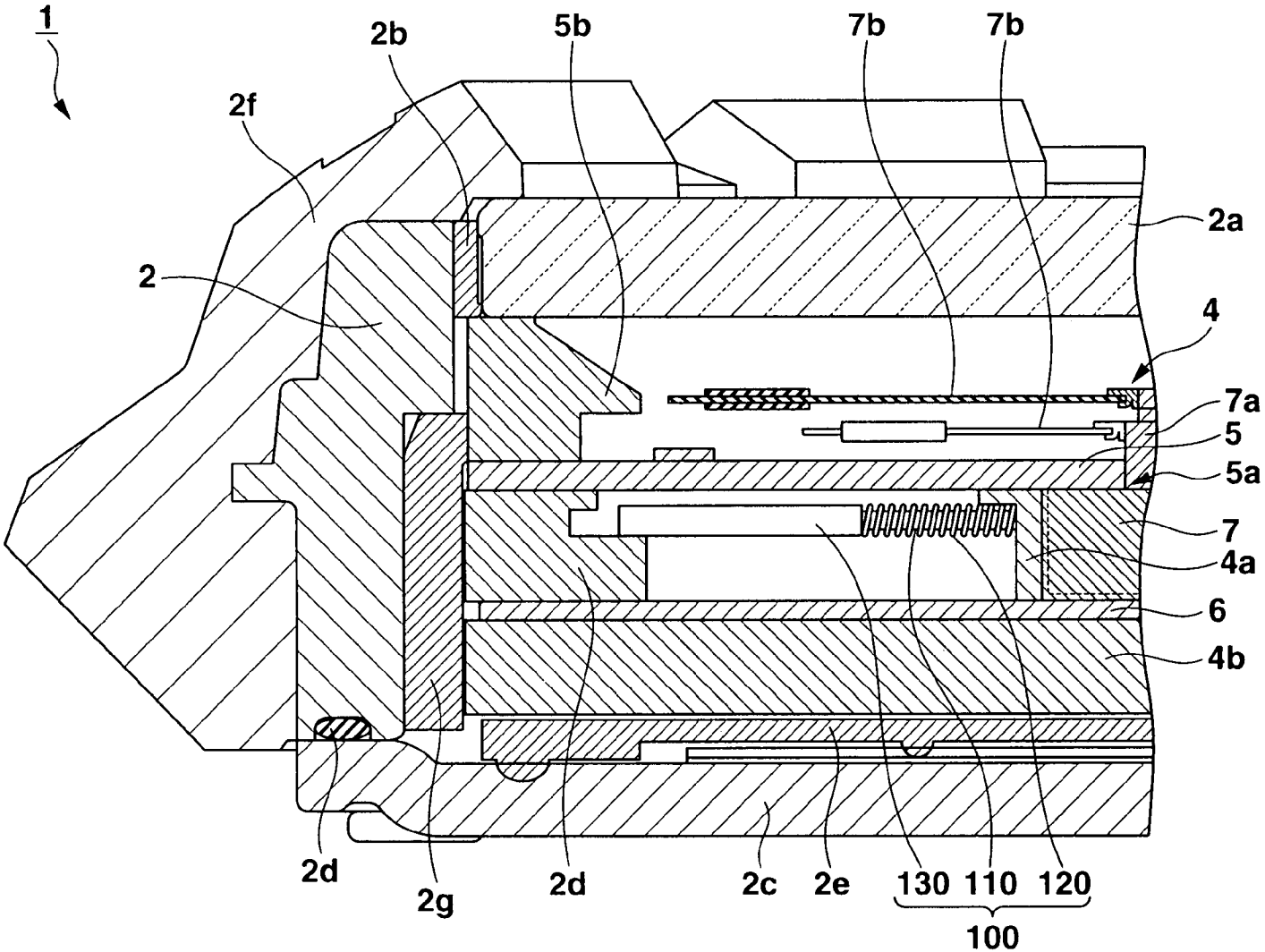
FIG. 5 is a partially broken sectional view of the wristwatch in FIG. 4.

FIG. 4 is a plan view of a wristwatch 1 in which the antenna 100 in the present invention is stored, and FIG. 5 is a sectional view of the wristwatch 1 on an arrow V—V in FIG. 4.

As shown in FIGS. 4 and 5, the wristwatch 1 comprises a watch case 2 made of resin in which a watch module 4 as a watch circuit is stored. A band member 8 is attached to the watch case 2 for a user to wear the wristwatch on the wrist.

At a center of the top surface of the watch case 2, there is a watch glass 2*a* engaged through a gasket 2*b* to make a dial 5 visible. A switch 3 is provided around the watch case 2 for instructing the execution of various functions. A bezel 2*f* is provided on the periphery of the upper portion of the watch case 2, and a back lid 2*c* molded with a metal is attached to the bottom surface of the watch case 2 through a waterproof ring 2*d*.

The watch module 4 comprises an upper housing 4*a*, a lower housing 4*b*, an analogue hand mechanism 7 for moving the hands such as an hour hand, second hand or the like above the dial 5, the antenna 100 for receiving the standard radio wave, a circuit board 6 which is connected to the analogue hand mechanism 7 or antenna 100 for controlling them.

A peripheral edge of each of the upper housing 4*a*, the lower housing 4*b* and the dial 5 is attached to an inner frame 2*g* provided on the peripheral surface of the inner side of the watch case 2.

The lower housing 4*b* is supported above a cushion member 2*e* provided on the upper side of the back lid 2*c*. The circuit board 6 is arranged between the upper and the lower housings 4*a* and 4*b*. The dial 5 is arranged on the upper surface of the upper housing 4*a*. A frame like member 5*b* is arranged on the upper surface of the periphery of the dial 5 in a state of contacting the lower surface of the periphery of the watch glass 2*a*.

The analogue hand mechanism 7 comprises a hand shaft 7*a* extending upward from an axis hole 5*a* formed in the dial 5 and a hand 7*b* such as an hour hand, a minute hand or the like attached to the hand shaft 7*a*, and is adapted to move the hand 7*a* above the dial 5. The battery for moving the analogue hand mechanism 7 is incorporated into the lower housing 4*b*.

The antenna 100 is arranged between the lower housing 4*b* and the dial 5 in a state of being supported by the upper housing 4*a* to make the axis line of the coil 120 be parallel to the back lid 2*c* (or the dial 5). A receiving circuit to detect the induced electromotive force generated in the coil 120 of the antenna 100 and receive the radio wave transmitted from outside is mounted on the circuit board 6.

Figure 6:
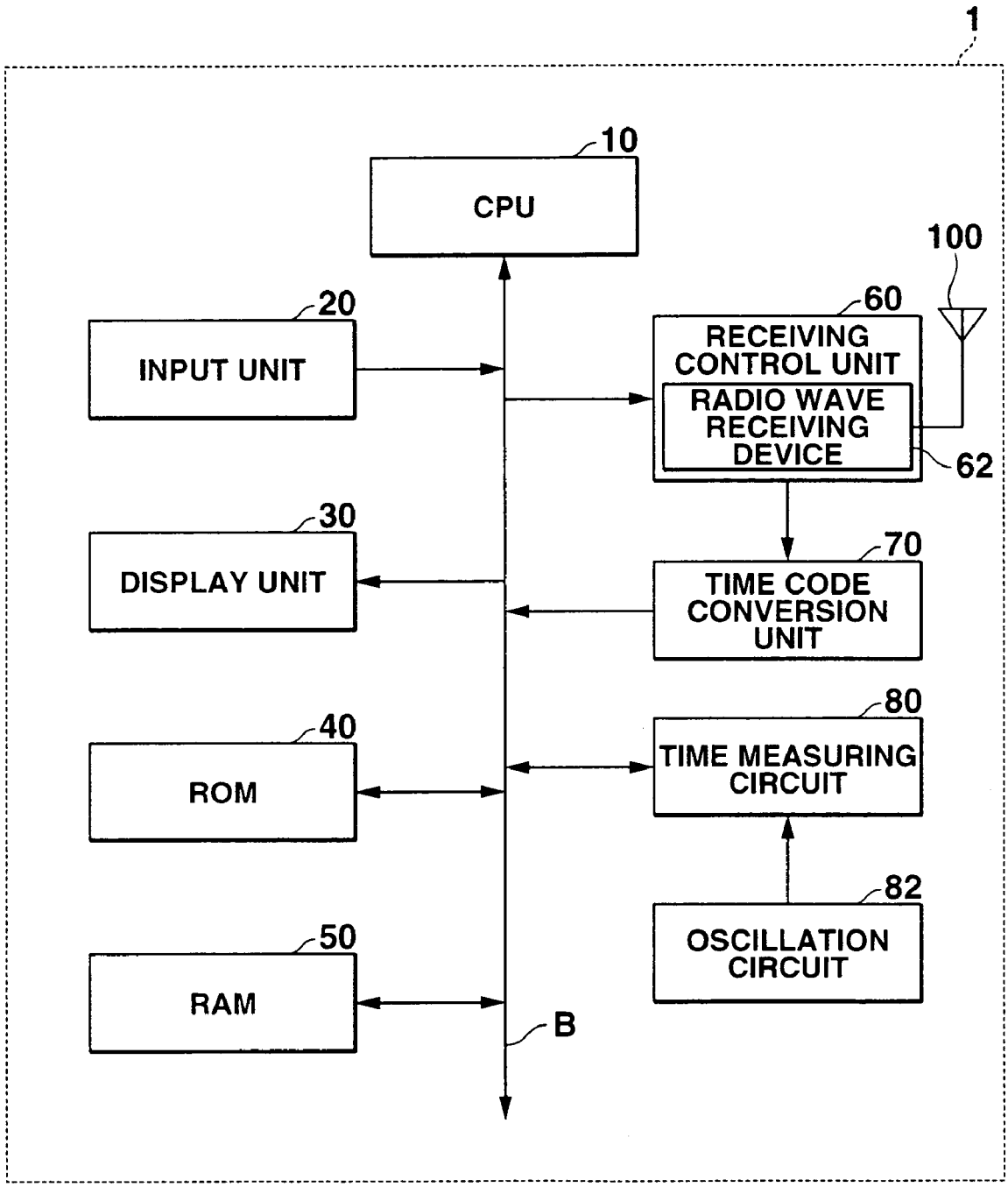
FIG. 6 is a block diagram showing an inside configuration of the wristwatch in FIG. 5.

FIG. 6 is a block diagram showing an inside configuration of the wristwatch 1. As shown in the figure, the wristwatch 1 comprises a CPU 10, an input unit 20, a display unit 30, a ROM 40, a RAM 50, a receiving control unit 60, a time code conversion unit 70, a time measuring circuit 80 and an oscillation circuit 82. All the parts excluding the oscillation circuit 82 are connected by the bus B, and the oscillation circuit 82 is connected to the time measuring circuit 80.

The CPU 10 reads out programs stored in the ROM 40 and expands the programs in the RAM 50 corresponding to a predetermined timing or a control signal input from the input unit 20, and executes an instruction, a data transfer or the like to each part of the wristwatch 1 based on the programs. Specifically, the CPU 10 controls the receiving control unit 60 every predetermined time and executes a standard radio wave receiving process, and corrects the current time data which is counted by the time measuring circuit 80 based on the standard time code input from the time code conversion unit 70.

The input unit 20 is the switch 3 or the like for instructing an execution of each function of the wristwatch 1. When the switch 3 is operated, a corresponding control signal is output to the CPU 10.

The display unit 30 includes the dial 5 and the analogue hand mechanism 7 which is controlled by the CPU 10, and displays the current time measured by the time measuring circuit 80.

The ROM 40 stores a system program for the wristwatch 1, an application program, a program for realizing this embodiment, various data and the like.

The RAM 50 is used as a work area for the CPU 10, and stores the program read from the ROM 40, data processed in the CPU 10 and the like.

The receiving control unit 60 comprises a radio wave receiving device 62. The radio wave receiving device 62 eliminates unnecessary frequency component of the standard radio wave received by the antenna 100 to select an appropriate frequency signal, and outputs the signal which is obtained by converting the frequency signal to the corresponding electric signal to the time code conversion unit 70.

The time code conversion unit 70 converts the electric signal input from the radio wave receiving device 62 to the digital signal, and generates the standard time code including the data necessary for the watch functions such as a standard time code, an accumulated day code, a day code or the like to output to the CPU 10.

The time measuring circuit 80 counts the signals input from the oscillation circuit 82 to measure the current time, and outputs this current time data to the CPU 10. The oscillation circuit 82 is a circuit to output a clock signal that has an always constant frequency.

[Effect of the First Embodiment]

As explained above, according to the antenna 100 in this embodiment, the following effects can be obtained.

(1) In the spaces X1 and X2 including the end portions 121 and 122 of the coil 120, the signal magnetic flux M1 passes the covering core 130, and there is an extremely small amount of signal magnetic flux M1 which crosses the end portions 121 and 122 of the coil 120. Thus, the loss generated by the signal magnetic flux M1 which passes (crosses) the end portions 121 and 122 of the coil 120 can be reduced.

(2) In the space Y near the center of the coil 120, the signal magnetic flux M1 passes the inside of the coil 120 through the core 110 and the covering core 130, and there is an extremely small amount of signal magnetic flux M1 which passes the outside of the coil 120 (that is, the signal magnetic flux M1 which does not pass the coil 120). Thus, the loss generated by the signal magnetic flux M1 passing the outside of the coil 120 can be reduced.

(3) Since the spread of the generated magnetic flux M2 is suppressed, the loss generated by the generated magnetic flux M2 passing through the metal 400 near the coil 120 (eddy current loss) can be reduced.

(4) Since the spread of the generated magnetic flux M2 is suppressed to have a sharp directivity, the coupling range of the generated magnetic flux M2 and the metal 400 near the coil 120 narrows. Thus, the loss generated by the generated magnetic flux M2 passing the metal 400 (eddy current loss) can be reduced.

(5) In this case, the coupling range of the generated magnetic flux M2 and the metal 400 narrows, so that the magnetic body which is arranged to prevent the coil 120 from magnetically coupling with the metal 400 can be small, thereby reducing the loss generated by the signal magnetic flux M1 passing the magnetic body 420.

(6) In the magnetic route surrounding the coil 120, since the covering core 130 having a high relative permeability is provided, the proportion of a portion having a high permeability increases, thereby increasing the effective permeability μe of the magnetic route as a whole. The inductance L of the coil 120 is proportional to the permeability μ and the square of the number of turns N, so that when the effective permeability pe increases, the number of turns N needed to obtain a certain inductance L can be small. Consequently, the loss by the resistance of the coil 120 can be reduced. In this case, the effective permeability pe is determined based on the size of the clearance 136 to determine the inductance L of the coil 120, so that a desired inductance L can be obtained by providing the clearance 136 with an appropriate size.

[Modified Example]

Applying the present invention is not limited to the above described embodiment, and it is to be understood that changes may be appropriately made without departing from the scope of the spirit of the present invention. For example, the antenna 100 may be configured as follows.

(A) In the Case of Forming Antenna with Amorphous

In the above described embodiment, the core 110 and the covering core 130 are formed with ferrite. Ferrite has an advantage that it is easily processed. However, the core 110 and the covering core 130 may be formed with other magnetic material, for example amorphous with high strength to impact.

Figure 7A:
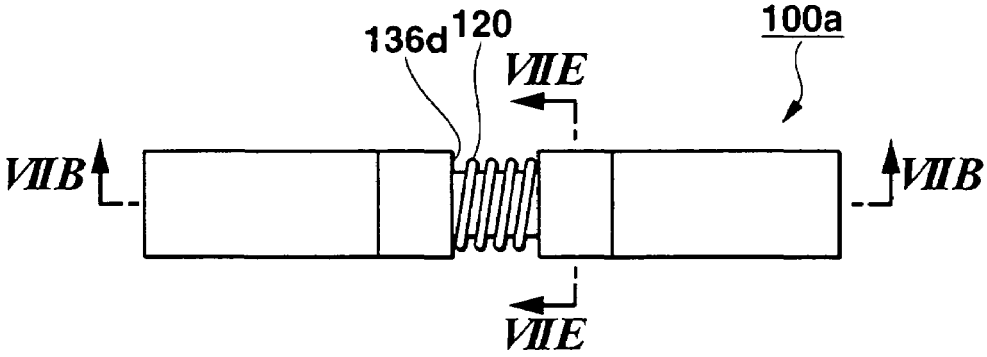
Figure 7B:
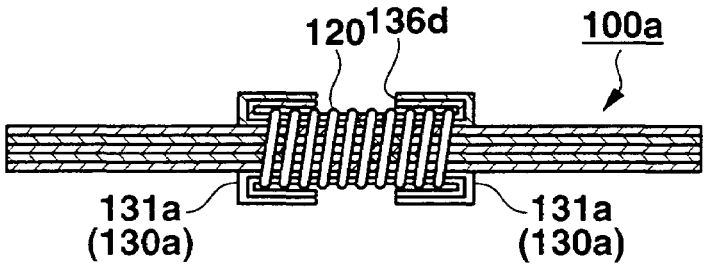
Figure 7C:
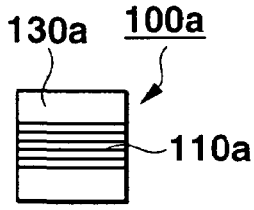
Figure 7D:
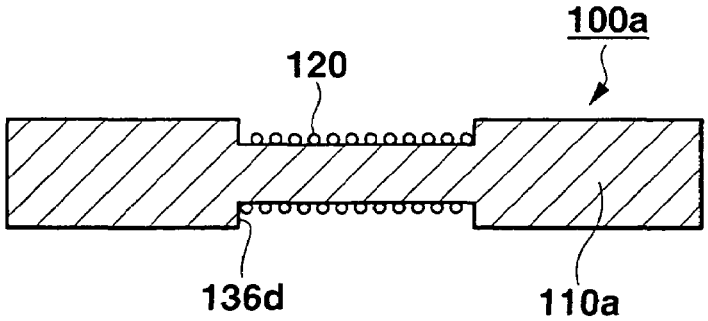
Figure 7E:
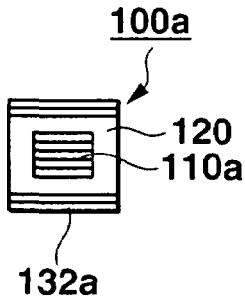

FIGS. 7A to 7E are views showing an antenna 100*a* formed with amorphous. FIG. 7A is a plan view of the antenna 100*a*, FIG. 7B is a sectional view on an arrow VIIB—VIIB in FIG. 7A, FIG. 7C is a right side view of FIG. 7A, FIG. 7D is a horizontal sectional view of FIG. 7A, and FIG. 7E is a sectional view on an arrow VIIE—VIIE in FIG. 7A.

According to the figures, the antenna 100*a* is configured such that the coil 120 is wound around the middle portion of a core 110*a* formed with amorphous. The core 110*a* is formed by laminating thin plate-shaped amorphous layers, and a recess is formed at the middle portion thereof around which the coil 120 wound. Both ends of some of the plurality of thin plate-shaped amorphous layers forming the core 110*a* from the top and the bottom are bent outwardly toward the middle portion of the coil 120 to cover the both end portions of the coil 120, thereby forming covering cores 131*a* and 132*a* having an L shape in section.

(B) In the Case of Forming Antenna by Combination of Ferrite and Amorphous

The antenna may be formed by a combination of ferrite and amorphous.

Figure 8A:
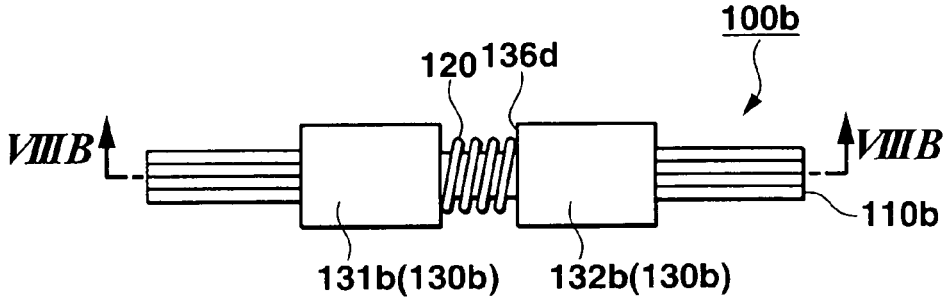
Figure 8B:
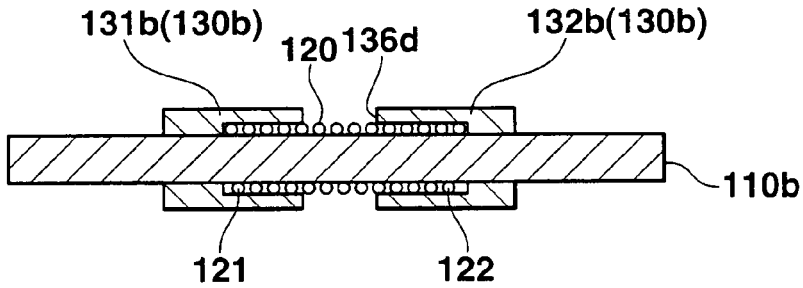

FIGS. 8A and 8B are views showing an antenna 100*b* formed by a combination of ferrite and amorphous. FIG. 8A is a front view of the antenna 100*b*, and FIG. 8B is a sectional view on an arrow VIIIB—VIIIB in FIG. 8A. According to the figures, in the antenna 100*b*, the coil 120 is wound around a core 110*b* which is formed by laminating the thin plate-shaped amorphous layers, and covering cores 131*b* and 132*b* formed with ferrite to cover the both end portions 121 and 122 of the coil 120 are provided on the periphery of the core 110*b*.

(C) In the Case of Providing Cut Portion in Covering Cores

The covering core 130 is magnetized by the signal magnetic flux M1 and the generated magnetic flux M2, so that the circulating current may flow. This may result in magnetically coupling the core 110 and the covering core 130, thereby generating loss. For suppressing the circulating current generated in the covering core 130, a cut portion may be provided in the covering core 130 along the axis direction of the core 110.

Figure 9A:
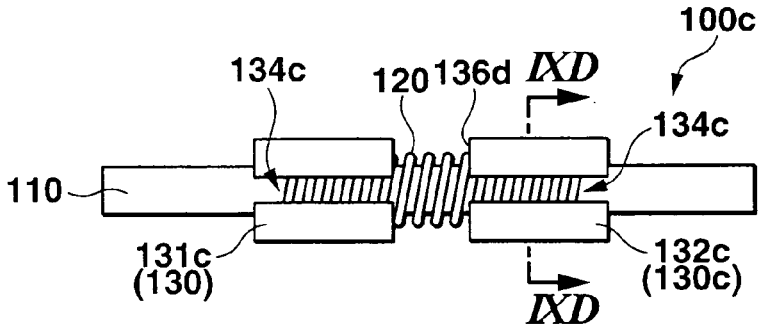
Figure 9B:
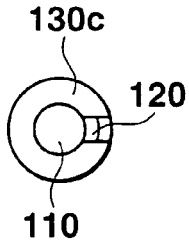
Figure 9C:
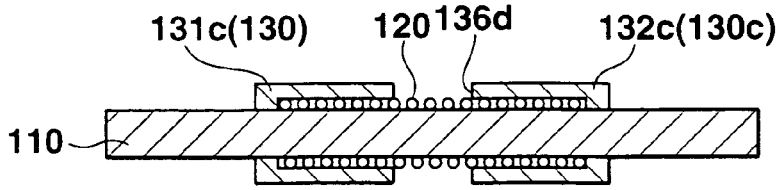
Figure 9D:
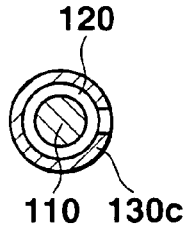

FIGS. 9A to 9D are views showing an antenna 100*c* which is provided with a cut portion in the covering core 130*c*. FIG. 9A is a front view of the antenna 100*c*, FIG. 9B is a right side view of FIG. 9A, FIG. 9C is a horizontal sectional view of FIG. 9A, and FIG. 9D is a sectional view on an arrow IXD—IXD in FIG. 9A. According to the figures, the covering core 130*c* is provided with the cut portion (slit) 134*c* which is parallel to the axis direction of the core 110. That is, the covering core 130*c* is formed into an approximately U shape in section (sectional view on the arrow IXD—IXD). The cut portion 134*c* is provided along the whole length of the covering core 130*c* in the longitudinal direction.

(D) In the Case of Forming End Portions of Covering Cores to be Inclined

The facing surfaces 130*d* of the covering core may be formed to be inclined to the direction vertical to the axis of the core 110.

Figure 10A:
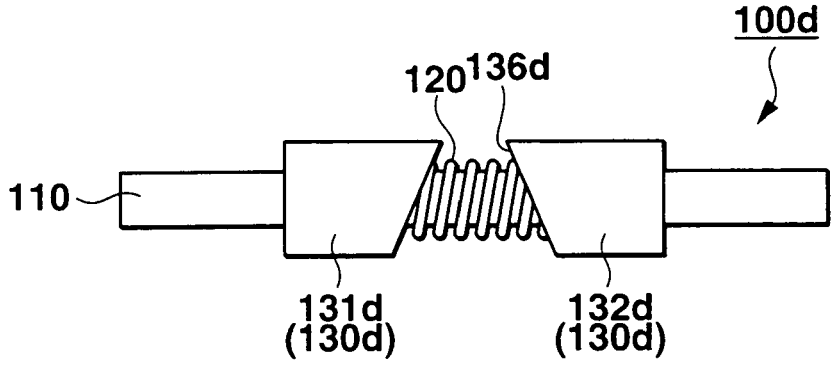
Figure 10B:
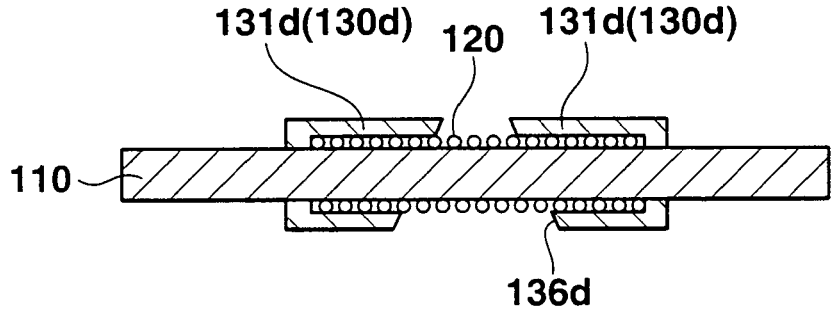
Figure 10C:
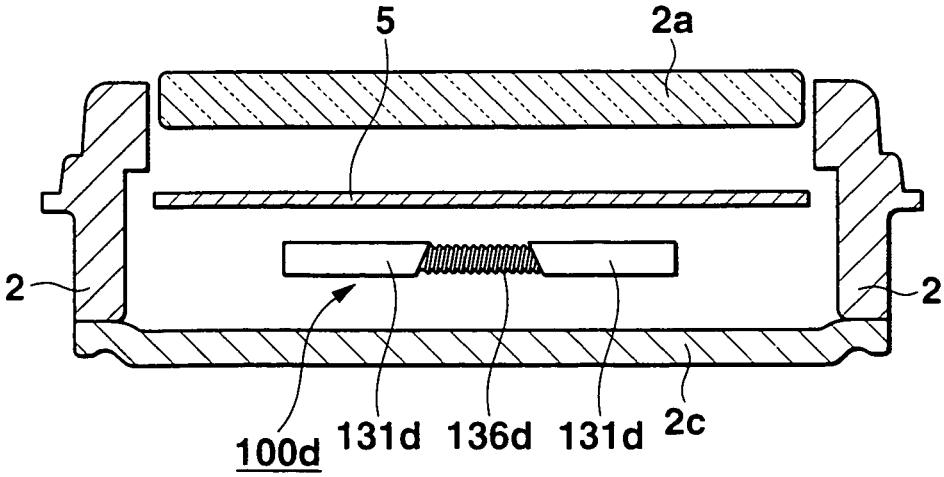

FIGS. 10A and 10B are views showing an antenna 100*d* in which the facing surfaces 130*d* of the covering core are formed to be inclined. FIG. 10A is a front view of the antenna 100*d*, and FIG. 10B is a vertical sectional view of FIG. 10A. According to FIGS. 10A and 10B, the facing surfaces 130*d* of the covering core are formed to be inclined at a predetermined angle to the axis direction of the core 110, so that the distance between the facing surfaces 136*d* the covering cores 131 and 132 narrows on the upper side of the coil 120 and spreads on the lower side of the coil 120. When the antenna 100*d* is store in the wristwatch 1, as shown in FIG. 10C which is a sectional view of a main portion of the wristwatch 1, the antenna 100*d* is arranged to make the portion in which the distance between the facing surfaces 136*d* is the narrowest, that is, the portion which has the highest directivity be directed upward (that is, to face the watch glass 2*a*).

(E) In the Case of Filling in Clearance between Covering Cores

The clearance 136 formed between the covering cores 131 and 132 may be covered by using a nonmagnetic material or a material with a much lower permeability compared to the magnetic material forming the core 110 or the covering core 130.

Figure 11A:
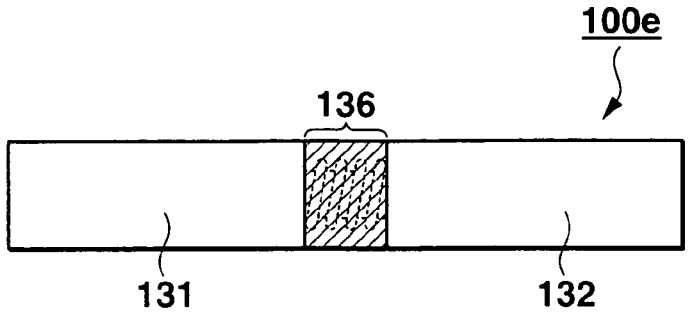
Figure 11B:
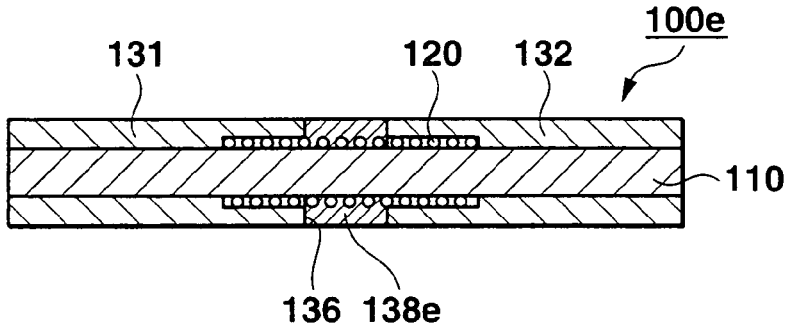

FIGS. 11A and 11B are views showing an antenna 100*e* in which the clearance 136 is filled in with a nonmagnetic material. FIG. 11A is a front view of the antenna 100*e*, and FIG. 11B is a vertical sectional view of FIG. 11A. According to the figures, in the antenna 100*e*, the clearance 136 between the covering cores 131 and 132 is filled in with a nonmagnetic body 138*e*. Even in this case, the magnetic resistance of the clearance 136 is much larger than that of the core 110 and the covering core 130, so that the generated magnetic flux M2 does not pass the nonmagnetic body 138*e*, but passes the inside of the coil 120 in near the center of the coil 120. Moreover, the middle portion of the coil 120 (which is not covered with the covering core 130) can be protected by the nonmagnetic body 138*e*. Examples of the nonmagnetic material to fill in (cover) the clearance 136 include resin, glass or the like.

(F) In the Case of not Covering End Portions of Coil with Covering Cores

The covering core 130 may not cover the end portions 121 and 122 of the coil 120.

Figure 12A:
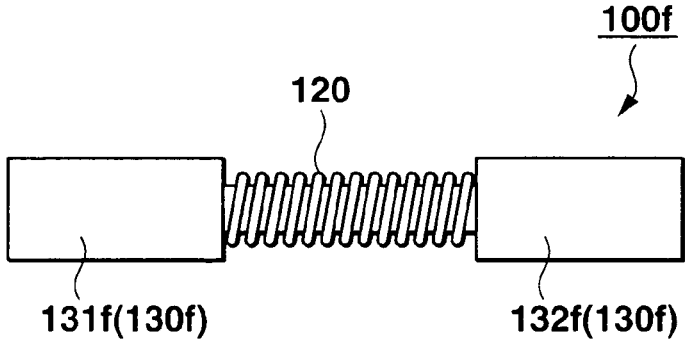
Figure 12B:
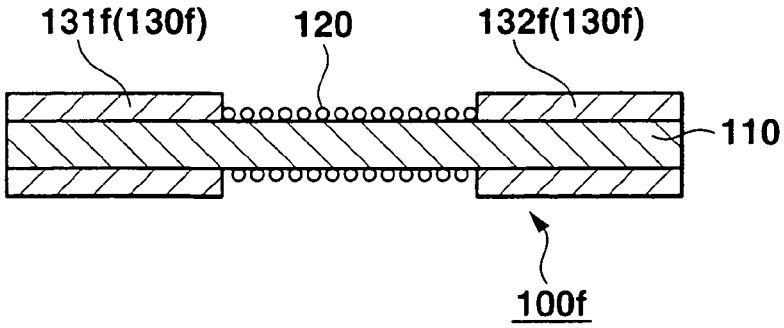

FIGS. 12A and 12B are view showing an antenna 100*f* in which the end portions 121 and 122 of the coil 120 are not covered by the covering core 130*f*. FIG. 12A is a front view of the antenna 100*f*, and FIG. 12B is a vertical sectional view of FIG. 12A. According to the figures, the antenna 100*f* is provided with covering cores 131*f* and 132*f* formed to project in the outer peripheral direction on the periphery of the core 110 as projecting portions. The coil 120 is wound between the covering cores 131*f* and 132*f*. Even in this case, near the both ends of the coil 120, the signal magnetic flux M1 and the generated magnetic flux M2 pass the covering cores 131*f* and 132*f* having a low relative permeability compared to the portion near the both end portions 121 and 122 of the coil 120.

As seen in the above explanations, the antenna according to the embodiment (for example, the antenna 100 in FIGS. 1A to 1D), comprises:

- a core (for example, the core 110 in FIGS. 1A to 1D);
- a coil (for example, the coil 120 in FIGS. 1A to 1D) which is wound on the core; and
- a magnetic body layer (for example, the covering core 130 in FIGS. 1A to 1D) to cover both end portions of the coil and a peripheral portion of the core other than a portion of the core on which the coil is wound.

According to the antenna comprising the structure, the antenna which comprises the core, the coil which is wound on the core, and the magnetic body layer to cover both end portions of the coil and the peripheral portion of the core other than the portion of the core on which the coil is wound can be realized. In the antenna, the core is magnetized by the segments of the magnetic field of the radio wave to receive, and the magnetic flux (generated magnetic flux) to oppose the time change of the magnetic flux passing the inside of the coil is generated, however, at this time, the magnetic flux (signal magnetic flux) generated by the segments of the magnetic field of the radio wave to receive and the generated magnetic flux pass the magnetic body layer covering each of the both end portions at the both end portions of the coil. That is, there is an extremely small amount of magnetic flux which crosses the end portions of the coil. Thus, the loss generated by the signal magnetic flux which crosses the coil can be reduced, thereby improving the receiver sensitivity of radio wave. In the outside of the coil, the magnetic flux which passes the outside of the coil (that is, the magnetic flux which does not pass the coil) in the signal magnetic flux passes the magnetic body layer to pass through the coil. Thus, the magnetic flux inside the coil increases (that is, magnetic field becomes strong), so that the receiver sensitivity improves.

The antenna according to the embodiment (for example, the antenna 100 in FIGS. 1A to 1D) comprises:

a bar shaped core (for example, the core 110 in FIGS. 1A to 1D);

a coil (for example, the coil 120 in FIGS. 1A to 1D) which is wound on an outer periphery of the core at a middle portion;

two covering parts (for example, the covering core 130 in FIGS. 1A to 1D) made of a magnetic material to cover the outer periphery of the core at both end portions; and circular shaped spaces (for example, the space 130*g* in FIG. 1C) which are formed in facing surfaces of the two covering cores, each of the circular shaped spaces being formed between an inner periphery of each of the two covering cores and the outer periphery of the core, wherein both end portions of the coil are inserted and arranged inside the circular shaped spaces.

According to the antenna comprising the structure, the antenna, which comprises a bar shaped core, a coil which is wound on an outer periphery of the core at a middle portion, two covering parts made of a magnetic material to cover the outer periphery of the core at both end portions and circular shaped spaces which are formed in facing surfaces of the two covering cores, each of the circular shaped spaces being formed between an inner periphery of each of the two covering cores and the outer periphery of the core, and in which both end portions of the coil are inserted and arranged inside the circular shaped spaces, can be realized. In the antenna, the core is magnetized by the segments of the magnetic field of the radio wave to receive, and the magnetic flux (generated magnetic flux) to oppose the time change of the magnetic flux passing the inside of the coil is generated, however, at this time, the magnetic flux (signal magnetic flux) generated by the segments of the magnetic field of the radio wave to receive and the generated magnetic flux pass the covering parts covering the both end portions at the both end portions of the coil. That is, there is an extremely small amount of magnetic flux which crosses the end portions of the coil. Thus, the loss generated by the signal magnetic flux which crosses the coil can be reduced, thereby improving the receiver sensitivity of radio wave. In the outside of the coil, the magnetic flux which passes the outside of the coil (that is, the magnetic flux which does not pass the coil) in the signal magnetic flux passes the covering parts to pass through the coil. Thus, the magnetic flux inside the coil increases (that is, magnetic field becomes strong), so that the receiver sensitivity improves.

In this case, as the antenna according to the embodiment shown in FIGS. 9A to 9D, cut portions (for example, the cut portion 134*c* in FIGS. 9A to 9D) may be formed in at least one of the covering parts along an axis direction of the core.

According to the antenna comprising the structure, the antenna which can obtain the same effect as the antenna shown in FIGS. 1A to 1D and in which the cut portion is formed in at least one of the covering parts along the axis direction of the core can be realized.

As the antenna according to the embodiment, a facing surface of at least one of the covering parts may be formed to be inclined to an axis direction of the core.

According to the antenna comprising the structure, the antenna which can obtain the same effect as the antenna shown in FIGS. 1A to 1D and in which the facing surface of at least one of the covering parts are formed to be inclined to the axis direction of the core can be realized.

The antenna according to the embodiment (for example, the antenna 100*a* in FIGS. 7A to 7E) comprises:

a core (for example, the core 110*a* in FIGS. 7A to 7E); and a coil (for example, the coil 120 in FIGS. 7A to 7E) which is wound on the core, wherein the core is provided with two hook portions (for example, the covering core 130*a* in FIGS. 7A to 7E) made of a material same as that of the core or a predetermined material on a peripheral surface, tip portions of the hook portions facing each other, and the coil is wound between the two hook portions.

According to the antenna comprising the structure, the antenna which comprises the core and the coil which is wound on the core, and in which the coil is wound between the two hook portions which are made of a material same as that of the core or a predetermined material and the tip portions of which face each other (that is, the both end portions of the core are covered with the hook portions) can be realized. In the antenna, the core is magnetized by the segments of the magnetic field of the radio wave to receive, and the magnetic flux (generated magnetic flux) to oppose the time change of the magnetic flux passing the inside of the coil is generated, however, at this time, the magnetic flux (signal magnetic flux) generated by the segments of the magnetic field of the radio wave to receive and the generated magnetic flux pass the hook portions covering the both end portions at the both end portions of the coil. That is, there is an extremely small amount of magnetic flux which crosses the end portions of the coil. Thus, the loss generated by the signal magnetic flux which crosses the coil can be reduced, thereby improving the receiver sensitivity of radio wave. In the outside of the coil, the magnetic flux which passes the outside of the coil (that is, the magnetic flux which does not pass the coil) in the signal magnetic flux passes the hook portions to pass through the coil. Thus, the magnetic flux inside the coil increases (that is, magnetic field becomes strong), so that the receiver sensitivity improves.

The antenna according to the embodiment (for example, the antenna 100*f* in FIGS. 12A and 12B) comprises:

a core (for example, the core 110 in FIGS. 12A and 12B); and a coil (for example, the coil 120 in FIGS. 12A and 12B) which is wound on the core, wherein the core is provided with two projecting portions (for example, the covering core 130*f* in FIGS. 12A and 12B) made of a material same as that of the core or a predetermined material on a peripheral surface, and the coil is wound between the two projecting portions.

According to the antenna comprising the structure, the antenna which comprises the core and the coil which is wound on the core, and in which the coil is wound between the two projecting portions formed with magnetic material (that is, the two projecting portions are provided near both end portions of the coil) can be realized. In the antenna, the core is magnetized by the segments of the magnetic field of the radio wave to receive, and the magnetic flux (generated magnetic flux) to oppose the time change of the magnetic flux passing the inside of the coil is generated, however, at this time, the magnetic flux (signal magnetic flux) by the segments of the magnetic field of the radio wave to receive and the generated magnetic flux pass the projecting portions near the both end portions of the coil at the both end portions of the coil. That is, there is an extremely small amount of magnetic flux which crosses the end portions of the coil. Thus, the loss generated by the signal magnetic flux which crosses the coil can be reduced, thereby improving the receiver sensitivity of radio wave. In the outside of the coil, the magnetic flux which passes the outside of the coil (that is, the magnetic flux which does not pass the coil) in the signal magnetic flux passes the projecting portions to pass through the coil. Thus, the magnetic flux inside the coil increases (that is, magnetic field becomes strong), so that the receiver sensitivity improves.

As the antenna according to the embodiment, a middle portion of the coil may be covered with a nonmagnetic material (for example, the nonmagnetic body 138*e* in FIGS. 11A and 11B).

According to the antenna comprising the structure, the antenna in which the middle portion of the coil is covered with the nonmagnetic material can be realized.

The watch device according to the embodiment (for example, the wristwatch 1 in FIG. 6), comprises:

the antenna shown in FIGS. 1A to 1D;

a time code generating section (for example, the time code conversion unit 70 in FIG. 6) to generate a standard time code based on a radio wave received by the antenna;

a time measuring section (for example, the time measuring circuit 80 in FIG. 6) to measure a current time; and a correction section (for example, the CPU 10 in FIG. 6) to correct the current time data which is measured by the time measuring section based on the standard time code generated by the time code generating section.

According to the watch device comprising the structure, the standard time code can be generated based on the radio wave received and the current time data can be corrected based on the standard time code generated.

Consequently, according to the embodiment, a loss generated in an antenna (specially, a bar antenna) can be reduced, and the receiver sensitivity of a radio wave can be improved.

[Second Embodiment]

The second embodiment will be explained.

<Configuration of Antenna>

Figure 13A:
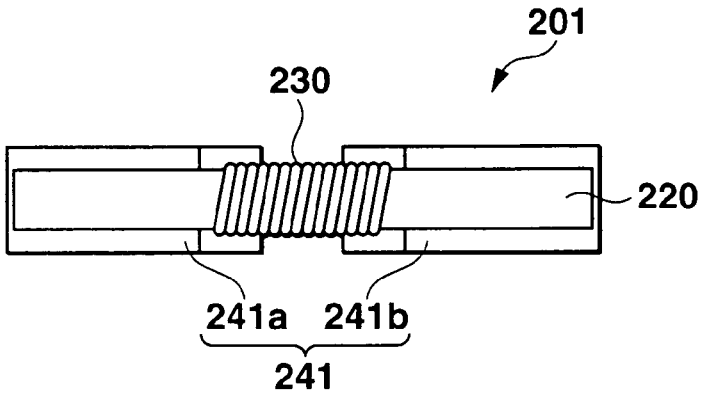
FIGS. 13A to 13D are views showing various structures of an antenna in the second embodiment of the present invention.
Figure 13B:
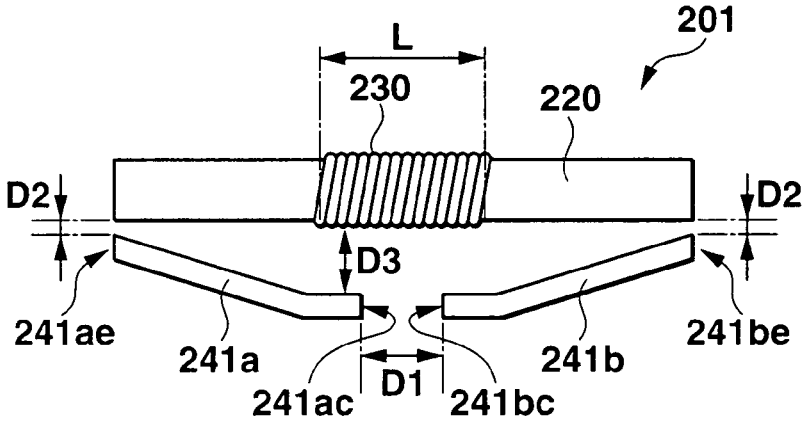
Figure 13C:
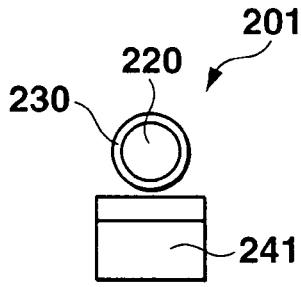
Figure 13D:
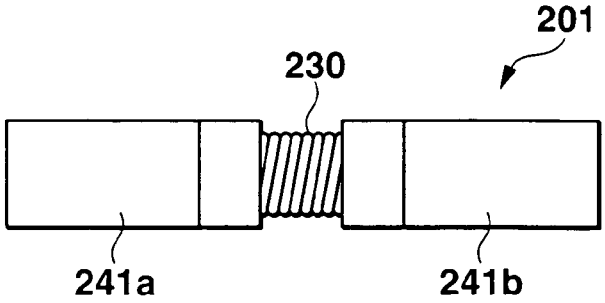

FIGS. 13A to 13D are views showing an antenna 201 in the second embodiment. FIG. 13A is a plane view of the antenna 201, FIG. 13B is a front view of the antenna 201, FIG. 13C is a right side view of FIG. 13B, and FIG. 13D is a bottom view of the antenna 201. As shown in figures, the antenna 201 comprises a cylindrical and bar shaped core 220, a coil 230 which is formed by winding a lead wire such as a copper or the like around the middle portion of the core 220, and a plate shaped magnetic member 241.

The core 220 and the magnetic member 241 are formed with a magnetic material having a high relative permeability (for example about 1,000 to 100,000) and a high electric resistance such as ferrite, amorphous or the like. Thus, the magnetic resistance in the core 220 and the magnetic member 241 is extremely small compared to the magnetic resistance in a space around the antenna 100, that is, about $1/1{,}000$ to $1/100{,}000$ of the magnetic resistance in the space around the antenna 201.

The magnetic member 241 is formed such that the length in the longitudinal direction is larger than the length L of the coil 230 in the axis direction, and the width (length in the width direction) is slightly larger than the diameter of the coil 230. The magnetic member 241 faces the periphery of the coil 230, and is arranged to make the longitudinal direction thereof be parallel to the axis direction of the core 220. Hereupon, the width of the magnetic member 241 is formed to be slightly larger than the diameter of the coil 230, however, it may be smaller than the diameter thereof.

Specifically, the magnetic member 241 comprises a pair of two magnetic body pieces 241*a* and 241*b* which is formed by bending both end portions of a plate-shaped member at approximately the same angle in the same direction and cutting it off at the middle portion facing the core 220. That is, the magnetic body pieces 241*a* and 241*b* are approximately the same size and shape. The distance between the magnetic body pieces 241*a* and 241*b*, that is, the distance D1 between end portions 241*ac* and 241*bc* in the middle facing the coil 230, is larger than the distance D2 between the portion of the core 220 on which the coil 230 is not wound and each of other ends 241*ae* and 241*be* of the magnetic body pieces 241*a* and 241*b*.

The magnetic body pieces 241*a* and 241*b* are bent so that the distance between the core 220 and each of the magnetic body pieces 241*a* and 241*b* is the largest at the end portions 241*ac* and 241*bc* in the middle facing the coil 230, and becomes small toward the other end portions 241*ae* and 241*be*. That is, with regard to the distance between the core 220 and each of the magnetic body pieces 241*a* and 241*b*, the distance D3 which is between the core 220 and each of the end portions 241*ac* and 241*bc* in the middle portion is the largest, and the distance D2 which is between the core 220 and each of the other end portions 241*ae* and 241*be* is the smallest.

<Distribution of Magnetic Flux>

When the antenna 201 is placed in the signal magnetic field by the standard radio wave, this magnetic field acts on the antenna 201 as follows.

Figure 14:
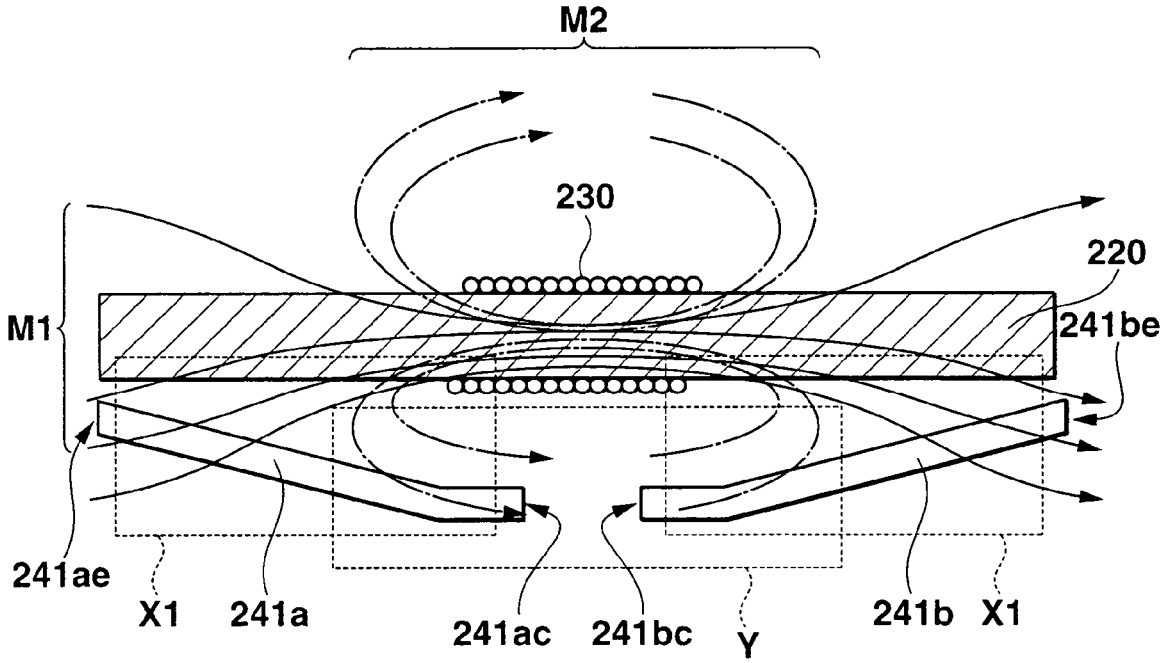
FIG. 14 is a view showing an action of a signal magnetic field on the antenna in the second embodiment of the present invention.

FIG. 14 is a vertical sectional view showing an action of the signal magnetic field on the antenna 201 by the standard radio wave. Hereupon, the signal magnetic field is a parallel magnetic field, and the antenna 201 is placed to make the axis line of the coil 230 be parallel to the direction of the magnetic field.

As shown in the figure, when the antenna 201 is placed in the signal magnetic field, the signal magnetic flux M1 (illustrated by solid lines in the figure) is concentrated in the core 220 and passes the coil 230, so that the generated magnetic flux M2 (illustrated by dashed lines in the figure) to oppose the change of the signal magnetic flux M1 passing the inside of the coil 230 is generated in the coil 120.

Specifically, the signal magnetic flux M1 is distributed as follows.

The magnetic resistance of the magnetic member 241 is extremely small compared to that in the air, so that it is considered that the signal magnetic flux M1 passes through the magnetic member 241 as much as possible. However, the distance D1 between the end portion 241*ac* of the magnetic body piece 241*a* in the middle portion and the end portion 241*bc* of the magnetic body piece 241*b* in the middle portion is longer than the distance D2 between the portion of the core 220 on which the coil 230 is not wound and each of the end portions 241*ae* and 241*be* of the magnetic body pieces 241*a* and 241*b*. Thus, the signal magnetic flux M1 takes the route to enter the core 220 by crossing the magnetic body piece 241*a* from the end portion 241*ae* side without passing between the magnetic body pieces 241*a* and 241*b*, and pass the inside of the core 220 to cross the magnetic body piece 241*b* from the end portion 241*ae* side. Hereupon, the position where the signal magnetic flux M1 which entered the magnetic body piece 241*a* from the end portion 241*ae* side passes through the magnetic body piece 241*a* to enter the core 220 changes depending upon the transmission condition of the radio wave to receive, the alternating level or the like.

Accordingly, in the space X1 in which the magnetic body piece 241*a* is arranged to face the core 220, the signal magnetic flux M1 which was attracted to the magnetic body piece 241*a* crosses the magnetic body piece 241*a* to enter the core 220, and takes the route to cross the magnetic body piece 241*b* in the space X2 in which the magnetic body piece 241*b* is arranged to face the core 220 after passing the inside of the coil 230.

The generated magnetic flux M2 is distributed as follows.

In the space Y in which the magnetic member 241 is arranged to face the core 220, the generated magnetic flux M2 takes the route to pass the inside of the magnetic body pieces 241*a* and 241*b* which have a high relative permeability compared to the surrounding space and are arranged along the direction of the generated magnetic flux M2, as long as possible. Therefore, the generated magnetic flux M2 which passes through the magnetic member 241 against the longitudinal direction of the magnetic member 241 can be reduced. Consequently, in the figure, compared to the upper side of the coil 230 in which the magnetic member 241 is not arranged, the spread of the generated magnetic flux M2 in up and down direction can be small.

[Wristwatch storing Antenna]

Next, an explanation will be made of an example in which the antenna 201 in this embodiment is stored in a radio watch.

Figure 15:
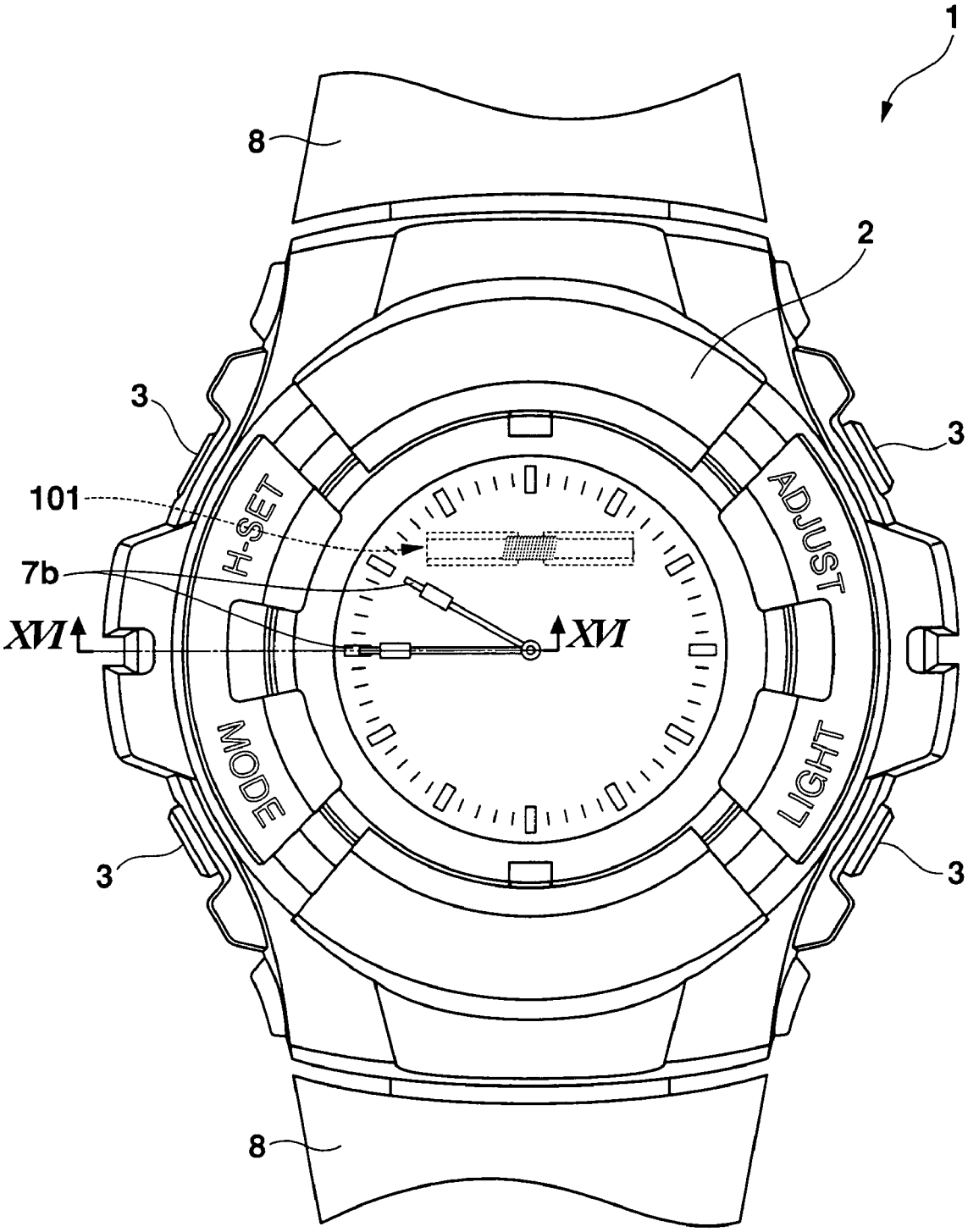
FIG. 15 is a plan view of a wristwatch in which the antenna in the second embodiment of the present invention is stored.
Figure 16:
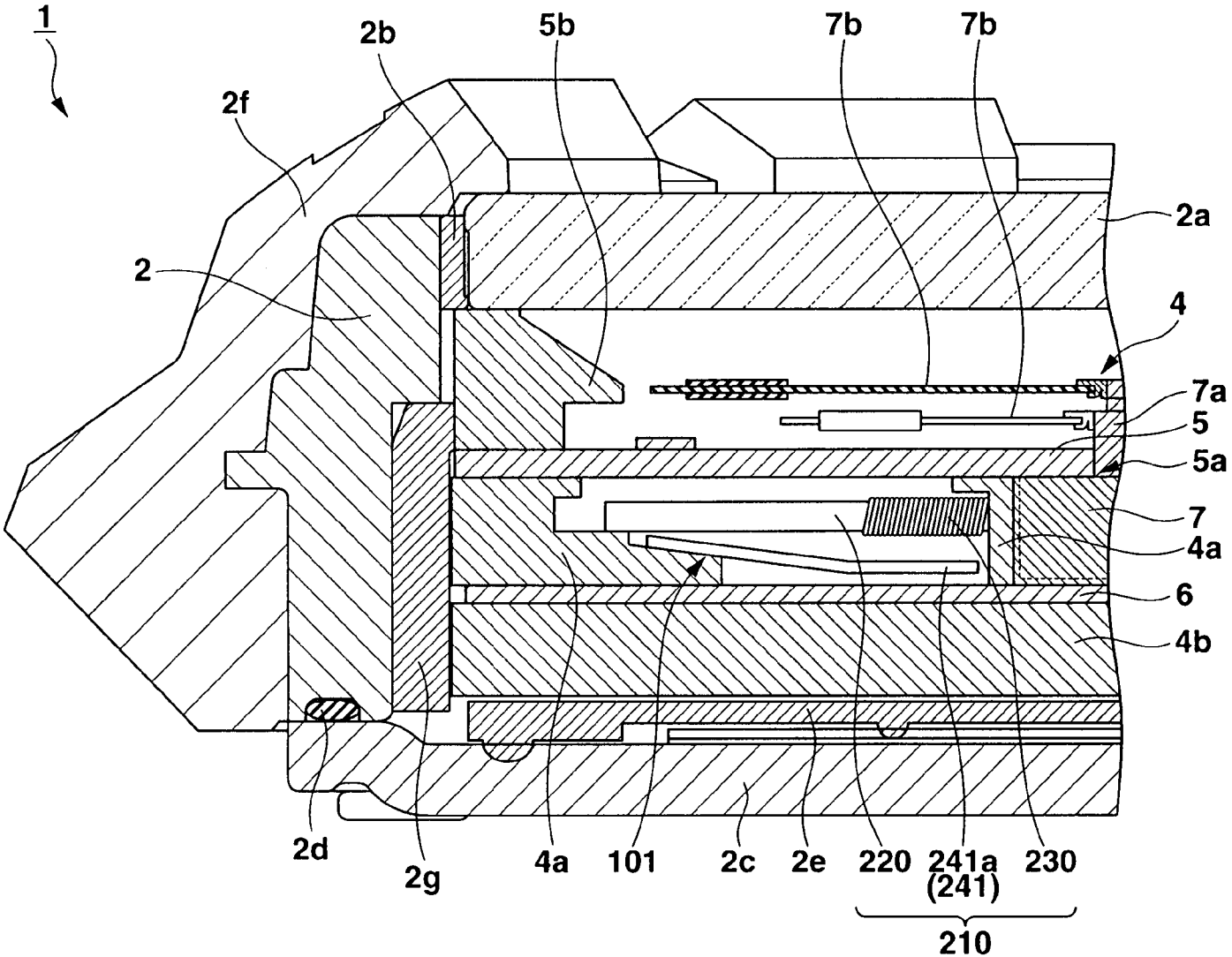
FIG. 16 is a sectional view of the wristwatch in which the antenna in the second embodiment of the present invention is stored.

FIG. 15 is a plan view of the wristwatch 1 in which the antenna 201 is stored, and FIG. 16 is a sectional view of the wristwatch 1 on an arrow XVI—XVI in FIG. 15. As shown in FIGS. 15 and 16, the wristwatch 1 comprises the watch case 2 made of resin in which the watch module 4 is stored. The band member 8 is attached to the watch case 2 for a user to wear the wristwatch on the wrist.

At a center of the top surface of the watch case 2, there is the watch glass 2*a* engaged through a gasket 2*b* to make a dial 5 visible. The switch 3 is provided around the watch case 2 for instructing the execution of various functions. The bezel 2*f* is provided on the periphery of the upper portion of the watch case 2, and the back lid 2*c* molded with a metal is attached to the bottom surface of the watch case 2 through a waterproof ring 2*d*.

The watch module 4 comprises the upper housing 4*a*, the lower housing 4*b*, the analogue hand mechanism 7 for moving the hands such as an hour hand, second hand or the like above the dial 5, the antenna 201 for receiving the standard radio wave, the circuit board 6 which is connected to the analogue hand mechanism 7 or antenna 100 for controlling them. A peripheral edge of each of the upper housing 4*a*, the lower housing 4*b* and the dial 5 is attached to the inner frame 2*g* provided on the peripheral surface of the inner side of the watch case 2.

The lower housing 4*b* is supported above the cushion member 2*e* provided on the upper side of the back lid 2*c*. The circuit board 6 is arranged between the upper and the lower housings 4*a* and 4*b*. The dial 5 is arranged on the upper surface of the upper housing 4*a*. The frame like member 5*b* is arranged on the upper surface of the periphery of the dial 5 in a state of contacting the lower surface of the periphery of the watch glass 2*a*.

The analogue hand mechanism 7 comprises the hand shaft 7*a* extending upward from the axis hole 5*a* formed in the dial 5 and the hand 7*b* such as an hour hand, a minute hand or the like attached to the hand shaft 7*a*, and is adapted to move the hand 7*a* above the dial 5. The battery for moving the analogue hand mechanism 7 is incorporated into the lower housing 4*b*.

The antenna 201 is arranged between the lower housing 4*b* and the dial 5. Specifically, the core 220 and the magnetic member 241 (magnetic body pieces 241*a* and 241*b*) are supported by the upper housing 4*a* to make the axis line of the coil 120 be parallel to the back lid 2*c* (or the dial 5) and make the magnetic 241 be parallel to the back lid 2*c* below the core 220 (back lid 2*c* side). A receiving circuit (refer to the radio wave receiving device 62 in FIG. 17) to detect the induced electromotive force generated in the coil 230 of the antenna 210 is mounted on the circuit board 6.

The antenna 201 is arranged so that the magnetic member 241 is positioned between the core 220 and the back lid 2*c*. Accordingly, on the back lid 2*c* side, the generated magnetic flux 241 passes the magnetic member 241, so that there is an extremely small amount of generated magnetic flux passing the back lid 2*c*, thereby suppressing the eddy current loss generated in the back lid 2*c*.

Figure 17:
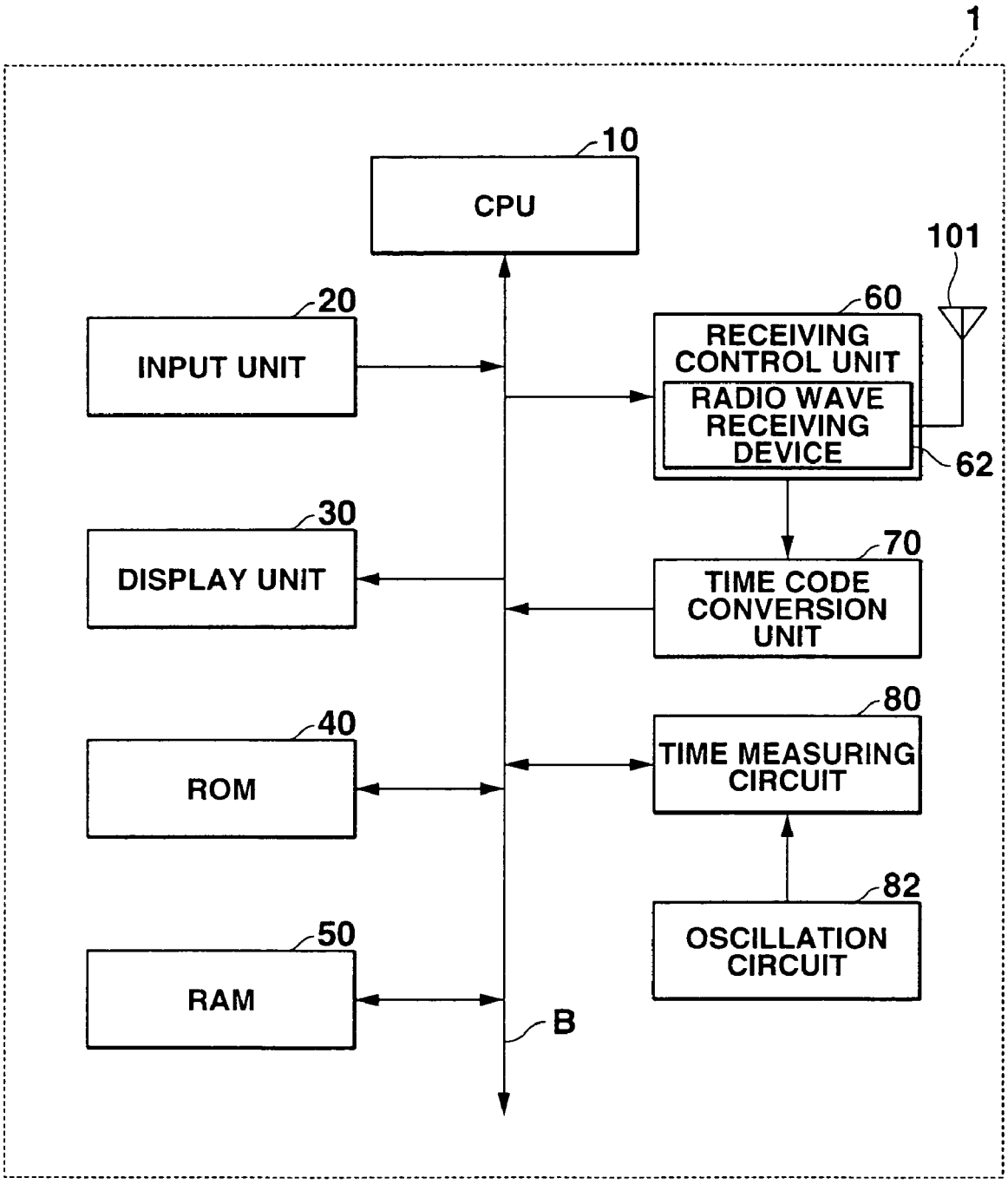
FIG. 17 is a block diagram showing an inside configuration of the wristwatch in the second embodiment of the present invention.

FIG. 17 is a block diagram showing an inside configuration of the wristwatch 1. As shown in the figure, the wristwatch 1 comprises the CPU 10, the input unit 20, the display unit 30, the ROM 40, the RAM 50, the receiving control unit 60, the time code conversion unit 70, the time measuring circuit 80 and the oscillation circuit 82. All the parts excluding the oscillation circuit 82 are connected by the bus B, and the oscillation circuit 82 is connected to the time measuring circuit 80.

The CPU 10 reads out programs stored in the ROM 40 and expands the programs in the RAM 50 corresponding to a predetermined timing or a control signal input from the input unit 20, and executes an instruction, a data transfer or the like to each part of the wristwatch 1 based on the programs. Specifically, the CPU 10 controls the receiving control unit 60 every predetermined time and executes a standard radio wave receiving process, and corrects the current time data which is counted by the time measuring circuit 80 based on the standard time code input from the time code conversion unit 70.

The input unit 20 is the switch 3 or the like for instructing an execution of each function of the wristwatch 1. When the switch 3 is operated, a corresponding control signal is output to the CPU 10.

The display unit 30 includes the dial 5 and the analogue hand mechanism 7 which is controlled by the CPU 10, and displays the current time measured by the time measuring circuit 80.

The ROM 40 stores a system program for the wristwatch 1, an application program, a program for realizing this embodiment, various data and the like.

The RAM 50 is used as a work area for the CPU 10, and stores the program read from the ROM 40, data processed in the CPU 10 and the like.

The receiving control unit 60 comprises the radio wave receiving device 62. The radio wave receiving device 62 eliminates unnecessary frequency component of the standard radio wave received by the antenna 201 to select an appropriate frequency signal, and outputs the signal which is obtained by converting the frequency signal to the corresponding electric signal to the time code conversion unit 70.

The time code conversion unit 70 converts the electric signal input from the radio wave receiving device 62 to the digital signal, and generates the standard time code including the data necessary for the watch functions such as a standard time code, an accumulated day code, a day code or the like to output to the CPU 10.

The time measuring circuit 80 counts the signals input from the oscillation circuit 82 to measure the current time, and outputs this current time data to the CPU 10. The oscillation circuit 82 is a circuit to output a clock signal that has an always constant frequency.

<Operation and Effect>

As explained above, according to the second embodiment, the following effects can be obtained.

(1) In the antenna 201, the magnetic resistance between the two magnetic body pieces 241*a* and 241*b* forming the magnetic member 241 is extremely high, so that the signal magnetic flux M1 attracted to the magnetic body piece 241*a* enters the core 220 to pass the inside of the coil 230. Thus, there is an extremely small amount of signal magnetic flux M1 which does not pass the core 220. That is, the signal magnetic flux M1 which passes the inside of the coil 230 increases, so that the receiver sensitivity is improved.

(2) By bending the magnetic body pieces 241*a* and 241*b*, the distance between the coil 230 and each of the magnetic body pieces 241*a* and 241*b* is the largest at the end portions 241*ac* and 241*bc* of the magnetic body pieces 241*a* and 241*b* in the middle portion in which the coil 230 is wound around the core 220, and becomes small toward the other end portions 241*ae* and 241*be*. Therefore, more signal magnetic flux M1 enters the core 220 to pass the inside of the coil 230, thereby further improving the receiver sensitivity of the antenna 201.

(3) Further, as shown in FIGS. 15 and 16, the antenna 201 is arranged in the wristwatch 1 so that the magnetic member 241 is positioned on the back lid 2*c* side and the core 220 is positioned on the dial 5 side. Thus, the eddy current loss generated in the back lid 2*c* formed with metal can be suppressed, and thereby realizing a wristwatch with improved receiver sensitivity.

[Third Embodiment]

Next, the third embodiment will be explained. In the third embodiment, the component that is same as in the second embodiment will be given the same reference numeral and the explanations thereof will be omitted.

<Configuration of Antenna>

Figure 18A:
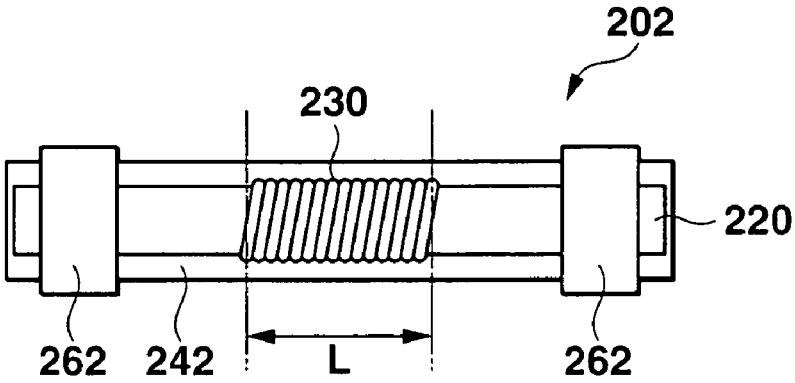
FIGS. 18A to 18D are views showing structures of an antenna in the third embodiment of the present invention.
Figure 18B:
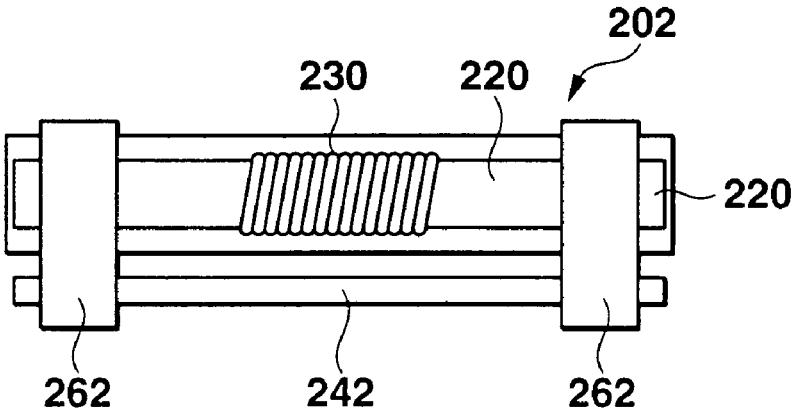
Figure 18C:
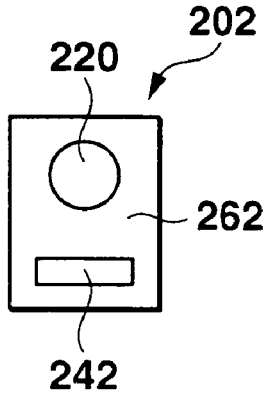
Figure 18D:
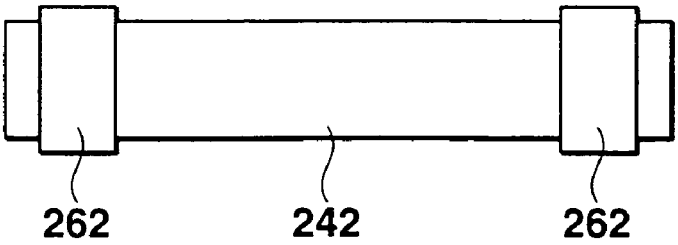

FIGS. 18A to 18D are views showing an antenna 202 according to the second embodiment. FIG. 18A is a plan view of the antenna 202, FIG. 18B is a front view of the antenna 202, FIG. 18C is a side view of FIG. 18B, and FIG. 18D is a bottom view of the antenna 202. According to the figures, the antenna 202 comprises the core 220 on which the coil 230 is wound at the middle portion, a magnetic member 242, and fixing members 262.

The magnetic member 242 is formed with a magnetic material such as ferrite or the like, and has a plate shape in which the length in the longitudinal direction is larger than the length L of the coil 230 and the width thereof is slightly larger than the diameter of the core 220. The magnetic member 242 faces the periphery of the coil 230, and is fixed to the core 220 by the fixing members 262 to make the longitudinal direction thereof be parallel to the axis direction of the core 220.

The fixing member 262 is formed with an insulating material such as resin or the like. The fixing members 262 fix the magnetic member 242 and the core 220 as a unit at both end portions thereof to keep the above described arrangement relationship.

The antenna 202 in which the fixing members 262 fix the magnetic member 242 and the core 220 as a unit is arranged in the wristwatch as follows. That is, similar to the above described second embodiment, the antenna 202 is arranged between the lower housing 4*b* and the dial 5 so that the magnetic member 242 is positioned below the core 220 (on the back lid 2*c* side) to be parallel to the back lid 2*c*. However, because the core 220 and the magnetic member 242 are fixed as a unit, there is no need to separately arrange the core 220 and the magnetic member 242.

<Operation and Effect>

According to the third embodiment, since the magnetic member 242 and the core 220 are fixed as a unit in the antenna 202, the antenna arrangement work to the inside of the wristwatch becomes easy, and the distance between the magnetic member 242 and the core 220 becomes constant. Accordingly, the inductance can be kept constant, so that the difference in inductance generated by a manufacturing error in each product or a tuning offset by the difference can be prevented. Consequently, homogeneous radio wave watches based on the design value can be easily produced in large quantities. In the antenna 202, the magnetic member 242 is positioned on the back lid 2*c* side, and the core 220 is positioned on the dial 5 side, so that the eddy current loss generated in the metal forming the back lid 2*c* can be suppressed to a minimum.

[Fourth Embodiment]

Next, the fourth embodiment will be explained. In the fourth embodiment, the component that is same as in the second and third embodiments will be given the same reference numeral and the explanations thereof will be omitted.

<Configuration of Antenna>

Figure 19A:
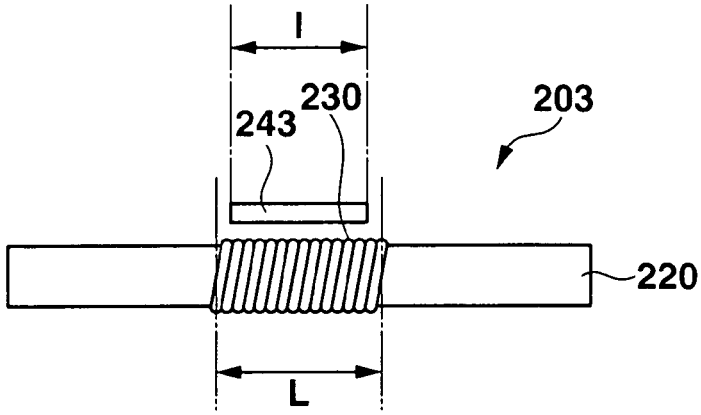
FIGS. 19A to 19C are views showing structures of an antenna of the fourth embodiment of the present invention.

FIG. 19A is a view showing an antenna 203 according to the fourth embodiment. According to the figure, the antenna 203 comprises the core 220 on which the coil 230 is wound at the middle portion and a magnetic member 243.

The magnetic member 243 is formed with a magnetic material such as ferrite or the like, and has a plate shape in which the length 1 in the longitudinal direction is smaller than the length L of the coil 230 wound on the core 220 and the width thereof is slightly larger than the diameter of the core 220. The magnetic member 243 faces the periphery of the coil 230, and is arranged to make the longitudinal direction thereof be parallel to the axis direction of the core 220.

<Magnetic Flux Distribution>

When the antenna 203 is placed in the signal magnetic field by the standard radio wave, the magnetic field acts on the antenna 203 as follows.

Figure 20:
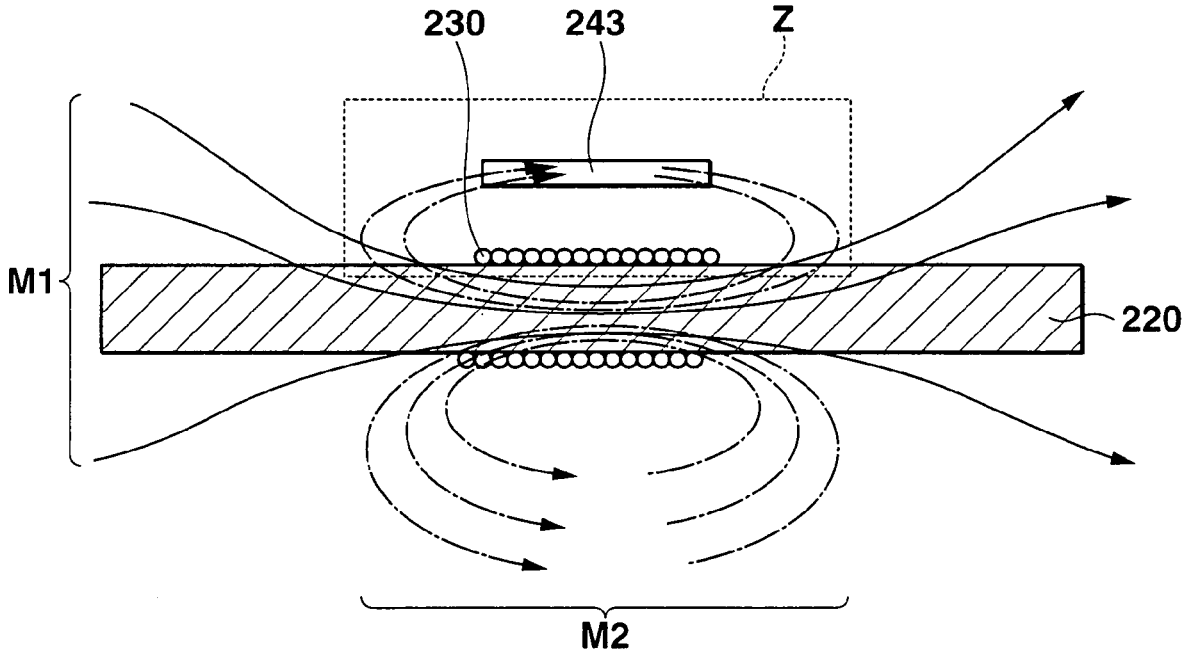
FIG. 20 is a view showing an action of a signal magnetic field on the antenna in the third embodiment of the present invention.

FIG. 20 is a vertical sectional view of the antenna 203 showing an action of the signal magnetic field on the antenna 203. Hereupon, the signal magnetic field is a parallel magnetic field, and the antenna 203 is placed to make the axis line of the coil 230 be parallel to the direction of the magnetic field.

According to the figure, the generated magnetic flux M2 is distributed as follows.

In a space Z in which the magnetic member 243 is arranged to face the core 220, the generated magnetic flux M2 is attracted to the magnetic member 243 having a high relative permeability compared to the surrounding space to be concentrated. Thus, the density of the generated magnetic flux M2 is increased in the area of the magnetic member 243 compared to the area in which the magnetic member 243 is not arranged (for example, the lower side of the coil 230 in the figure), thereby sharpening the directivity.

The signal magnetic flux M1 is distributed as follows.

In the space Z, a part of the signal magnetic flux Ml is attracted to the magnetic member 243 to pass therethrough. However, in the other area, since the length of the magnetic member 243 is smaller than the length L of the coil 230, the signal magnetic flux M1 enters the core 220 to pass the inside of the coil 230 without passing the magnetic member 243.

<Wristwatch storing Antenna>

The antenna 203 is arranged in the wristwatch as follows.

Figure 19B:
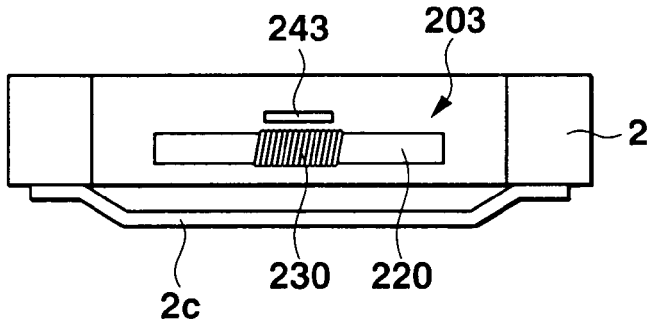
Figure 19C:
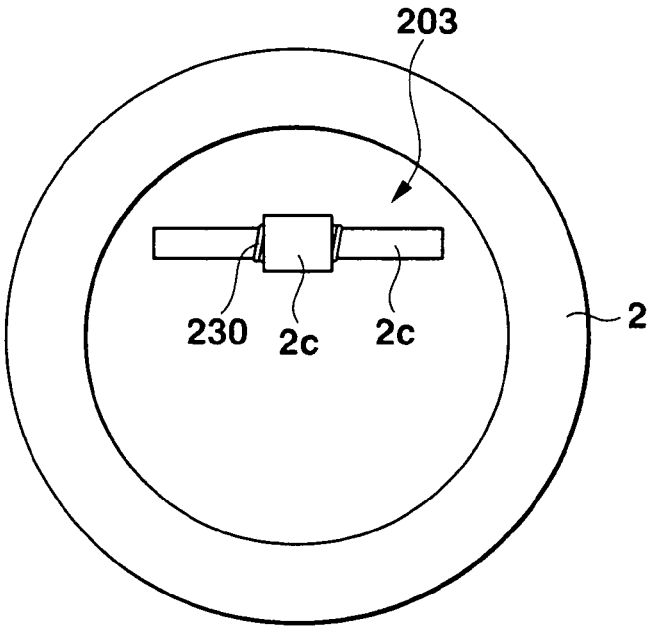

FIG. 19B is a vertical sectional view of a main portion of the wristwatch storing the antenna 203, and FIG. 19C is a horizontal sectional view of a main portion of the wristwatch. According to the figures, the antenna 203 is arranged between the lower housing 4*b* and the dial 5 so that the axis direction of the core 220 is parallel to the back lid 2*c* (or the dial 5) and the magnetic member 243 is positioned on the upper side of the core 220 (on the dial 5 side) to be parallel to the dial 5.

<Operation and Effect>

As explained above, according to the fourth embodiment, in the antenna 203, since the magnetic member 243 is shorter than the length L of the coil 230, a high directivity can be provided in the area in which the magnetic member 243 is arranged to face the core 220 compared to the other area. Accordingly, as shown in FIGS. 19B and 19C, by positioning the magnetic member 243 on the dial 5 side, and positioning the core 220 on the back lid 2*c* side, a wristwatch with improved receiver sensitivity can be realized.

MODIFIED EXAMPLE

Applying the present invention is not limited to the above described three embodiments, and it is to be understood that changes may be appropriately made without departing from the scope of the spirit of the present invention. For example, the antenna may be configured as follows.

(A) In the Case of Combining Core and Magnetic Member

For example, in the antenna in the above described second and fourth embodiments, the magnetic member and the core and formed separately, however, they may be combined. By combining the magnetic member and the core, the inductance can be kept constant, so that the difference in inductance generated by a manufacturing error in each product or a tuning offset by the difference can be prevented in comparison with the earlier case in which the core and the magnetic member are arranged separately.

Figure 21:
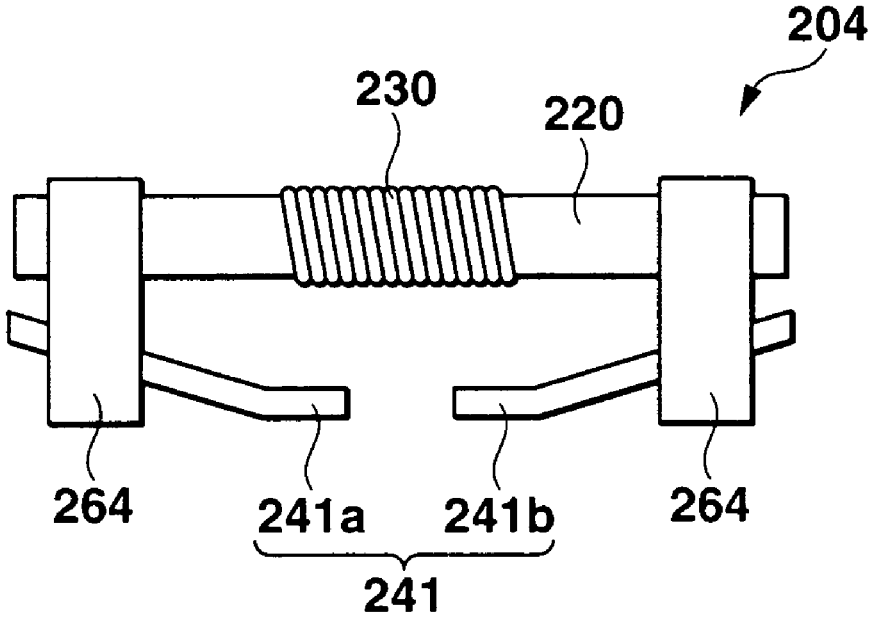
FIG. 21 is a view showing a structure of an antenna in which the magnetic member and the core are combined in the second embodiment of the present invention.

(A-1) In the Case of Combining Core and Magnetic Member in the Second Embodiment FIG. 21 is a view showing an antenna 204 in which the magnetic member 241 and the core 220 are combined in the second embodiment. According to the figure, the antenna 204 comprises the core 220 on which the coil 230 is wound at the middle portion, a magnetic member 241, and fixing members 264.

The fixing member 264 is formed with an insulating material such as resin or the like. The fixing member 264 fixes the magnetic body pieces 241*a* and 241*b* and the core 220 as a unit to keep the arrangement relationship in the above described second embodiment.

Figure 22:
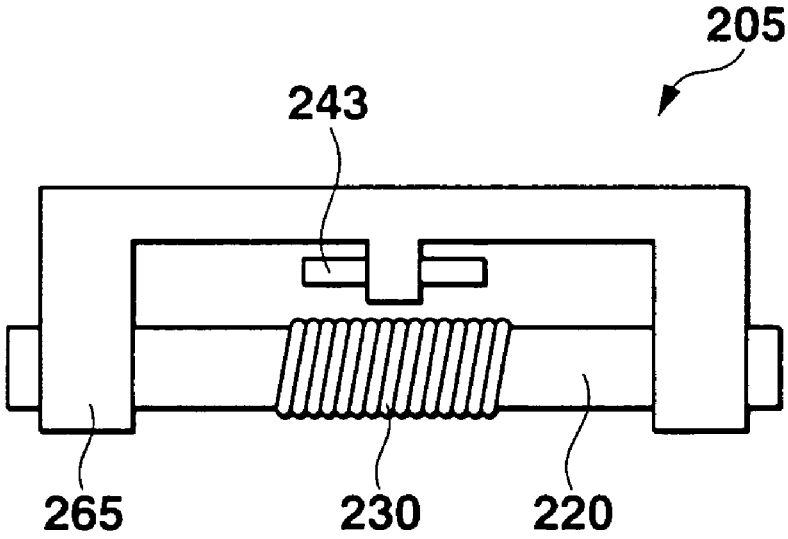
FIG. 22 is a view showing a structure of an antenna in which the magnetic member and the core are combined in the fourth embodiment of the present invention.

(A-2) In the Case of Combining Core and Magnetic Member in the Fourth Embodiment FIG. 22 is a view showing an antenna 205 in which the magnetic member 243 and the core 220 are combined in the fourth embodiment. According to the figure, the antenna 205 comprises the core 220 on which the coil 230 is wound at the middle portion, a magnetic member 243, and a fixing member 265.

The fixing member 265 is formed with an insulating material such as resin or the like. The fixing member 265 fixes the magnetic member 243 and the core 220 as a unit to keep the arrangement relationship in the above described fourth embodiment.

(B) Shape of Magnetic Body

In the above described second embodiment, each of the magnetic body pieces 241*a* and 241*b* is formed by bending a plate-shaped body at one point, however, it may be bent at a plurality of points, or may have a shape as follows.

(B-1) In the Case of Forming Magnetic Body into Curved Shape

Figure 23A:
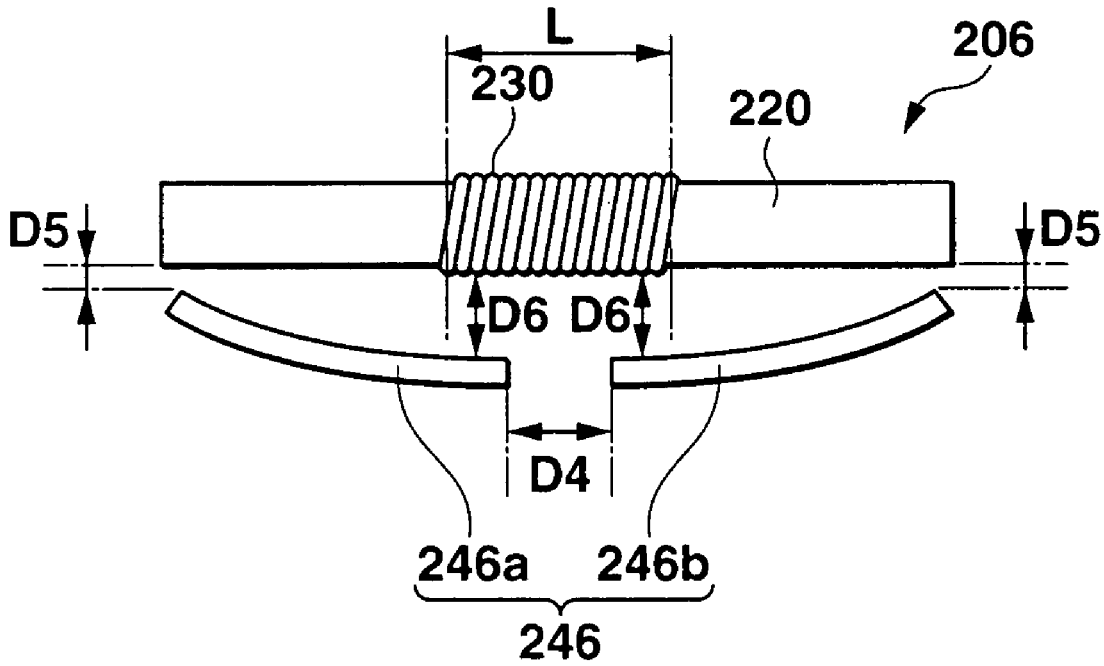
FIG. 23A is a view showing a structure of an antenna in which magnetic body pieces are formed into a curved shape in the second embodiment of the present invention.

FIG. 23A is a view showing an antenna 206 in which magnetic body pieces are formed into a curved shape. According to the figure, the antenna 206 comprises the core 220 on which the coil 230 is wound at the middle portion and a magnetic member 246.

The magnetic member 246 comprises two magnetic body pieces 246*a* and 246*b* which are curved to have approximately the same size and shape. Each of the magnetic body pieces 246*a* and 246*b* is arranged so that the inner curved surface face the periphery of the coil 230. The distance between the magnetic body pieces 246*a* and 246*b*, that is, the distance D4 between the end portions 241*ac* and 241*bc* in the middle facing the coil 230, is larger than the distance D5 between the portion of the core 220 on which the coil 230 is not wound and each of other ends of the magnetic body pieces 246*a* and 246*b*.

The magnetic pieces 246*a* and 246*b* are bent so that the distance between the core 220 and each of the magnetic body pieces 246*a* and 246*b* is the largest at the end portions in the middle facing the coil 230 of the core 220, and becomes small toward the other end portions. That is, with regard to the distance between the core 220 and each of the magnetic body pieces 246*a* and 246*b*, the distance D6 which is between the core 220 and each of the end portions in the middle is the largest and the distance D5 which is between the core 220 and each of the other end portions is the smallest.

Figure 23B:
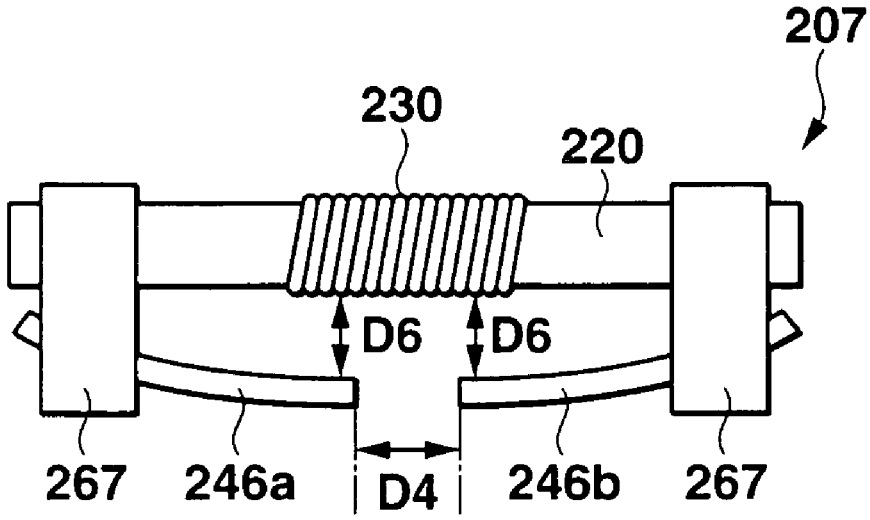
FIG. 23B is a view showing a structure of an antenna in which the magnetic member and the core are combined in FIG. 23A.

Further, in this case, as shown in FIG. 23B, an antenna 207 may be formed so that the magnetic body pieces 246*a* and 246*b* and the core 220 are fixed as a unit by fixing members 267 formed with an insulating material to keep the arrangement relationship between the above described magnetic member 246 and the core 220.

(B-2) In the Case of Forming Magnetic Body into Plate Shape

Figure 24A:
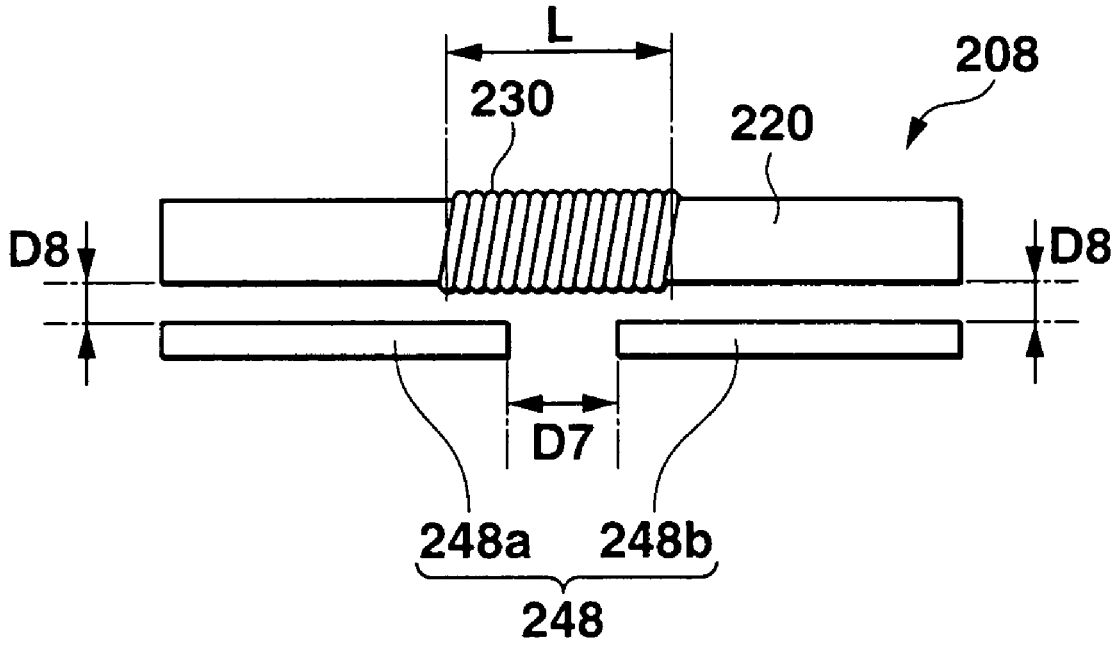
FIG. 24A is a view showing a structure of an antenna in which magnetic body pieces are formed into a plate shape in the second embodiment of the present invention.

FIG. 24A is a view showing an antenna 208 in which magnetic body pieces are formed into a plate shape. According to the figure, the antenna 208 comprises the core 220 on which the coil 230 is wound at the middle portion and a magnetic member 248.

The magnetic member 248 comprises two magnetic body pieces 248*a* and 248*b* which are formed to have a plate shape with approximately the same size. Each of the magnetic body pieces 248*a* and 248*b* is arranged so that the longitudinal direction thereof is parallel to the axis direction of the core 220. The distance D7 between the magnetic body pieces 248*a* and 248*b* is larger than the distance D8 between the portion of the core 220 on which the coil 230 is not wound and each of the magnetic body pieces 248*a* and 248*b*.

Figure 24B:
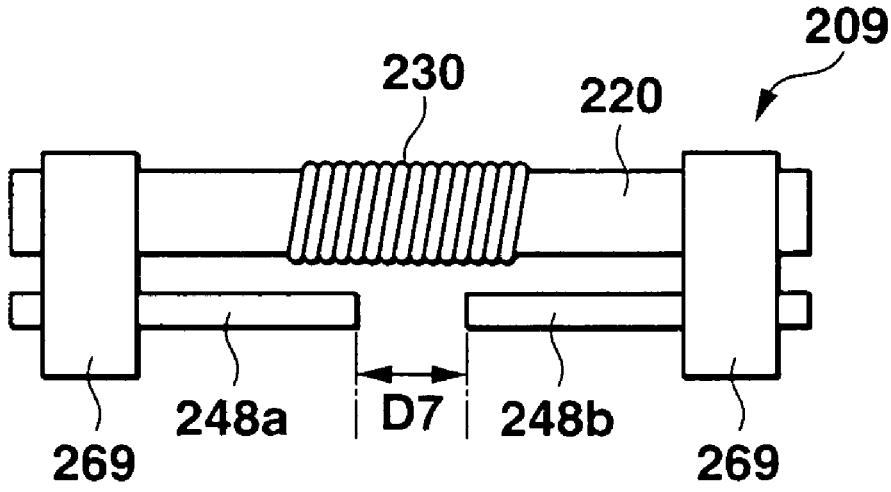
FIG. 24B is a view showing a structure of an antenna in which the magnetic member and the core are combined in FIG. 24A.

Further, in this case, as shown in FIG. 24B, an antenna 209 may be formed so that the magnetic body pieces 248*a* and 248*b* and the core 220 are fixed as a unit by fixing members 269 formed with an insulating material to keep the arrangement relationship between the above described magnetic member 248 and the core 220.

(C) The Number of Magnetic Body Pieces Forming Magnetic Member

In the above described second embodiment, the magnetic member 241 comprises two magnetic body pieces 241*a* and 241*b*, however, it may comprise three or more magnetic body pieces.

Figure 25A:
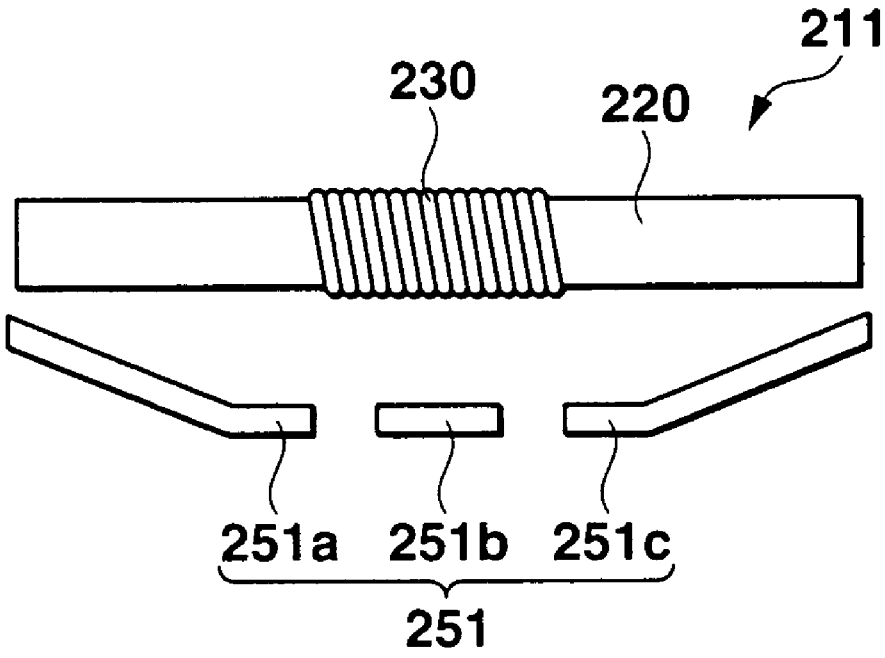
FIG. 25A is a view showing a structure of an antenna in which the magnetic member comprises three magnetic body pieces in the present invention.

(C-1) In the Case of Comprising Three or More Magnetic Body Pieces in the Second Embodiment FIG. 25A is a view showing an antenna 211 in which a magnetic member comprises three magnetic body pieces. According to the figure, the antenna 211 comprises the core 220 on which the coil 230 is wound at the middle portion and a magnetic member 251.

The magnetic member 251 comprises three magnetic body pieces 251*a*, 251*b* and 251*c* which are formed by bending both end portions of a plate-shaped member at approximately the same angle in the same direction and cutting it off at two points facing the core 220.

Figure 25B:
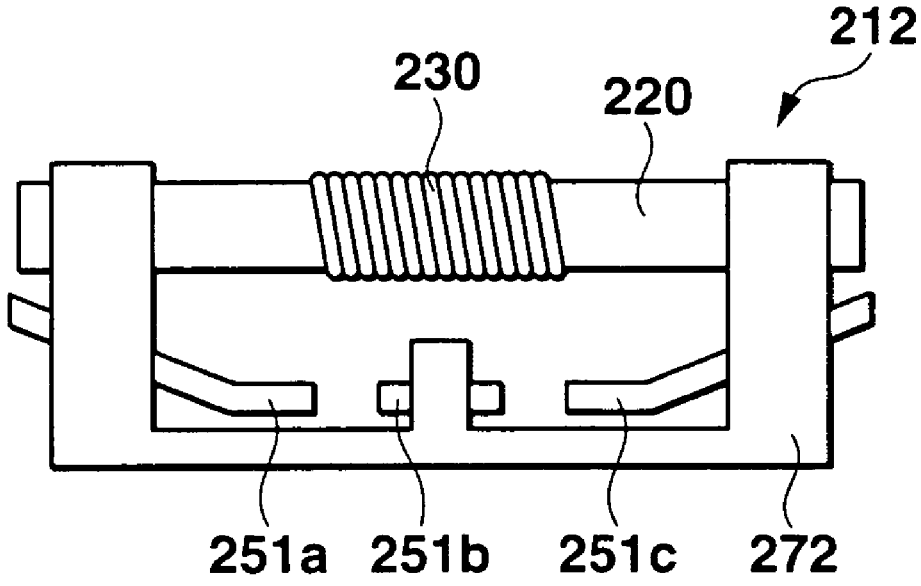
FIG. 25B is a view showing a structure of an antenna in which the magnetic member and the core are combined in FIG. 25A.

Further, in this case, as shown in FIG. 25B, an antenna 212 may be formed so that the magnetic member 251 and the core 220 are fixed as a unit by a fixing member 272 formed with an insulating material to keep the arrangement relationship between the above described magnetic member 251 and the core 220.

(C-2)

The magnetic member may comprise three or more magnetic body pieces in the above described modified embodiment (B-2) (refer to FIGS. 24A and 24B).

Figure 26A:
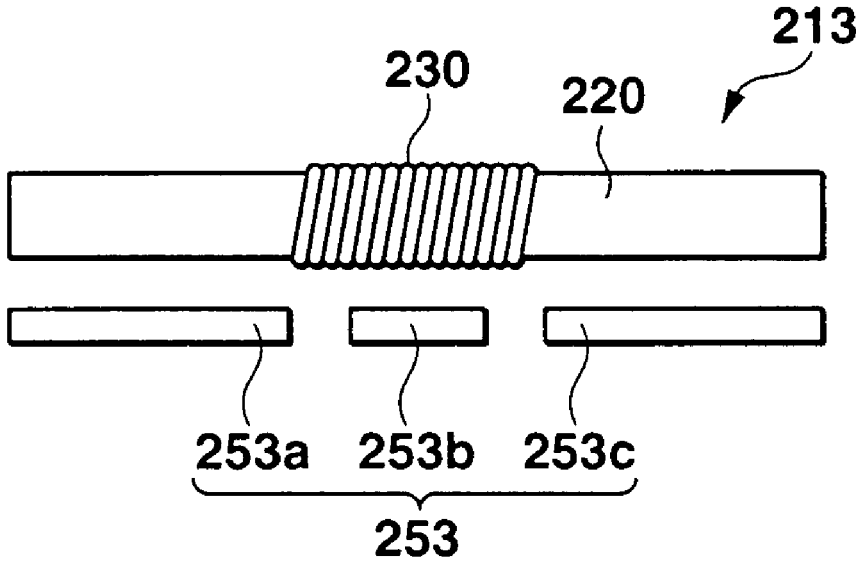
FIG. 26A is a view showing a structure of an antenna in which the magnetic member comprises three magnetic body pieces in the present invention.
Figure 26B:
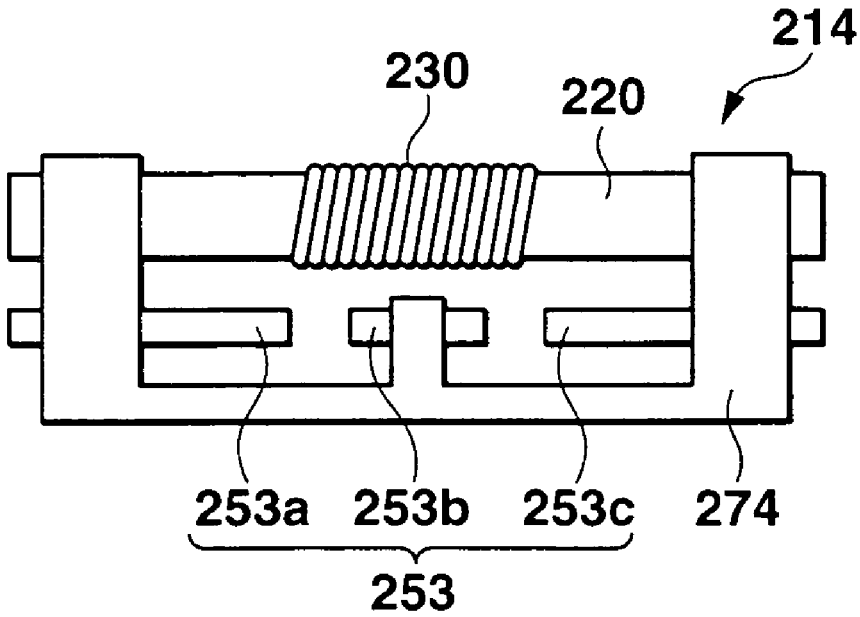
FIG. 26B is a view showing a structure of an antenna in which the magnetic member and the core are combined in FIG. 26A.

FIG. 26A is a view showing an antenna 213 in which a magnetic member comprises three magnetic body pieces. According to the figure, the antenna 213 comprises the core 220 on which the coil 230 is wound at the middle portion and a magnetic member 253.

The magnetic member 253 comprises three magnetic body pieces 253*a*, 253*b* and 253*c* which are formed to have a plate shape with approximately the same size. Each of the magnetic body pieces 253*a*, 253*b* and 253*c* is arranged so that the longitudinal direction thereof is parallel to the axis direction of the core 220.

Further, in this case, as shown in FIG. 25B, an antenna 214 may be formed so that the magnetic body pieces 253*a*, 253*b* and 253*c* and the core 220 are fixed as a unit by a fixing member 274 formed with an insulating material to keep the arrangement relationship between the above described magnetic member 253 and the core 220.

(D) In the Case of Coupling between Magnetic Body Pieces

In the above described second embodiment, the cut portion of the magnetic member 241, that is, between the magnetic body pieces 241*a* and 241*b* may be coupled by a coupling member which is formed with a nonmagnetic material or a material with a much lower relative permeability compared to the magnetic material forming the core 220 or the magnetic member 241.

Figure 27:
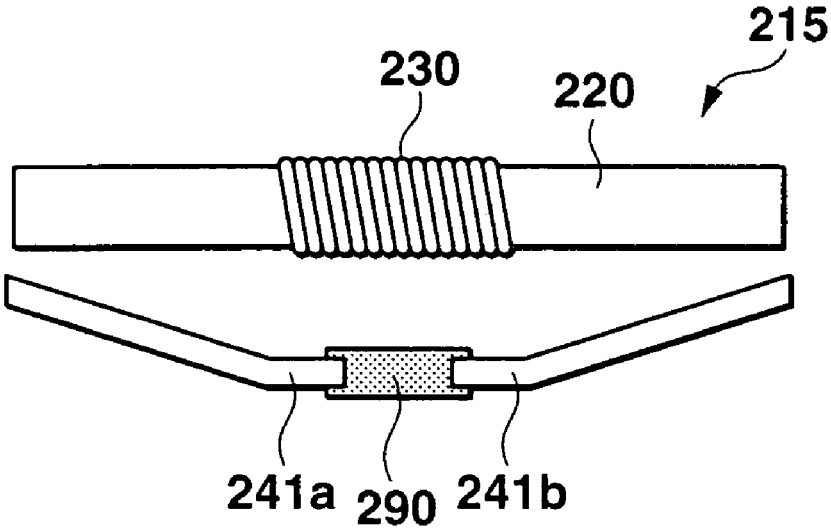
FIG. 27 is a view showing a structure of an antenna in which the magnetic body pieces are coupled in the second embodiment of the present invention.

FIG. 27 is a view showing an antenna 215 in which the magnetic body pieces 241*a* and 241*b* are coupled in the second embodiment. According to the figure, the antenna 215 comprises the core 220 on which the coil 230 is wound at the middle portion, the magnetic member 241 (magnetic body pieces 241*a* and 241*b*), and a coupling member 290.

The coupling member 290 is formed with a nonmagnetic material (or may be formed with a material with a much lower relative permeability compared to the magnetic material forming the core 220 or the magnetic member 241), and couples the magnetic body pieces 241*a* and 241*b*. The magnetic body pieces 241*a* and 241*b* are fixed as a unit by the coupling member 290, so that it makes easy to manufacture wristwatches. Moreover, since the distance D1 between the magnetic body pieces 241*a* and 241*b* is kept constant, the effects such as preventing manufacturing error or the like can be achieved.

FIG. 27 shows the case where the coupling member 290 is applied to the second embodiment, however, it is to be understood that a coupling member may be applied to each of the above described modified embodiments (A-1), (B) and (C) to form an antenna in which magnetic body pieces are coupled by a coupling member.

(E) In the Case of Forming Magnetic Member with Amorphous

In the above described second to fourth embodiments, the magnetic member is formed with ferrite, however, it may be formed with amorphous.

Figure 28:
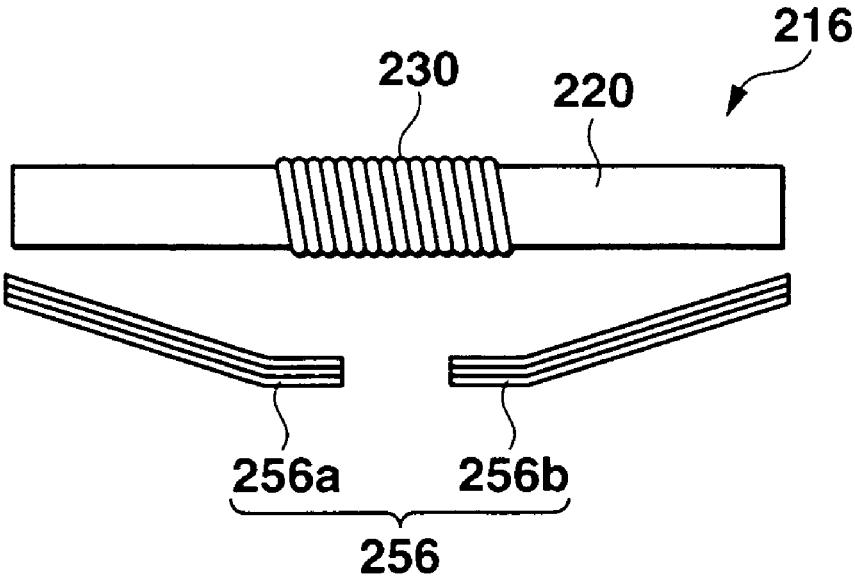
FIG. 28 is a view showing a structure of an antenna in which the magnetic body member is formed with amorphous in the second embodiment of the present invention.

FIG. 28 is a view showing an antenna 216 in which the magnetic member is formed with amorphous. According to the figure, the antenna 216 comprises the core 220 on which the coil 230 is wound at the middle portion and the magnetic member 256.

The magnetic member 256 comprises magnetic body pieces 256*a* and 256*b* which have approximately the same size and shape. Each of the magnetic body pieces 256*a* and 256*b* is formed by laminating thin plate-shaped amorphous layers. Since amorphous has a high electric conductivity compared to ferrite, the eddy current is easily generated by magnetic flux passing through amorphous. Thus, the magnetic body pieces 256*a* and 256*b* are formed by laminating the thin plate-shaped amorphous layers to decrease the effective electric conductivity, thereby suppressing the generation of the eddy current in the magnetic member 256.

(F) In the Case of arranging a Plurality of Magnetic Members

In the above described second and third embodiments, the antenna comprises one magnetic member, however, it may comprise a plurality of magnetic members.

Figure 29A:
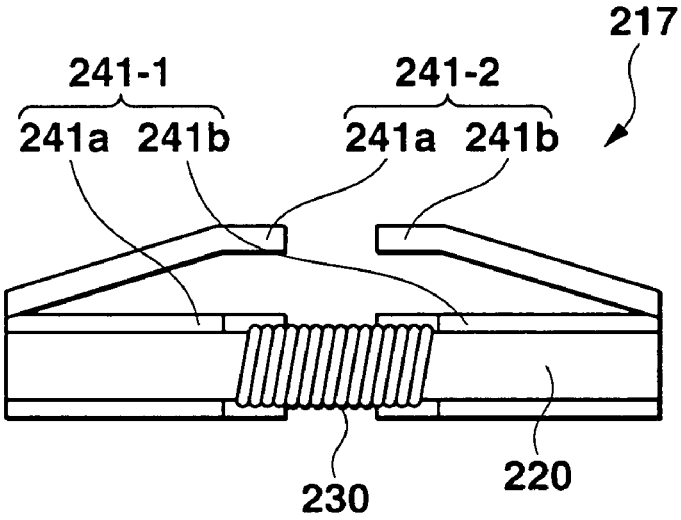
FIGS. 29A to 29C are views showing structures of an antenna having two magnetic members in the second embodiment of the present invention.
Figure 29B:
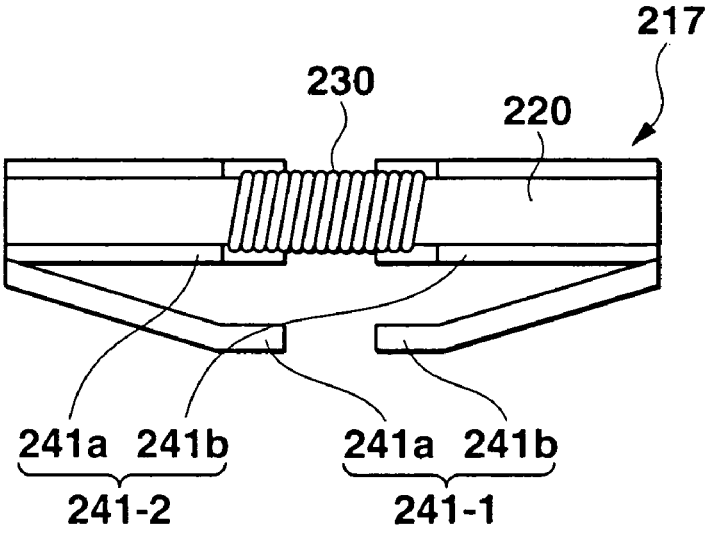
Figure 29C:
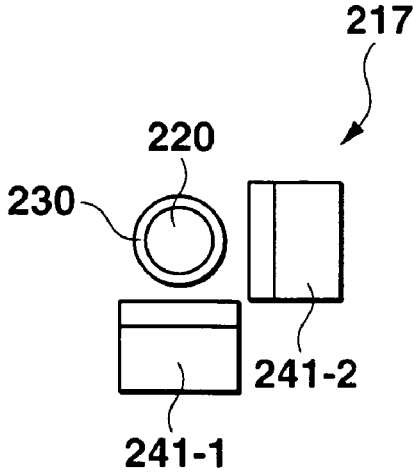

(F-1) In the Case of Arranging a Plurality of Magnetic Members in the Second Embodiment FIGS. 29A to 29C are views showing an antenna 217 comprising two magnetic members 241-1 and 241-2. FIG. 29A is a plan view of the antenna 217, FIG. 29B is a front view of the antenna 217, and FIG. 29C is a side view of the antenna 217. According to the figures, the antenna 217 comprises the core 220 on which the coil 230 is wound at the middle portion and two magnetic members 241-1 and 241-2. The two magnetic members 241-1 and 241-2 are arranged at an about 90 degrees interval along the circumferential direction of the core 220.

Figure 30A:
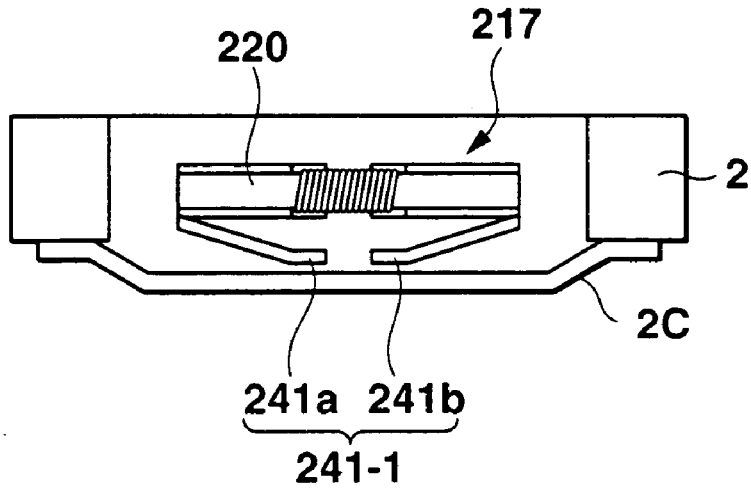
FIG. 30A is a sectional view of a wristwatch storing the antenna having two magnetic members in the second embodiment of the present invention.
Figure 30B:
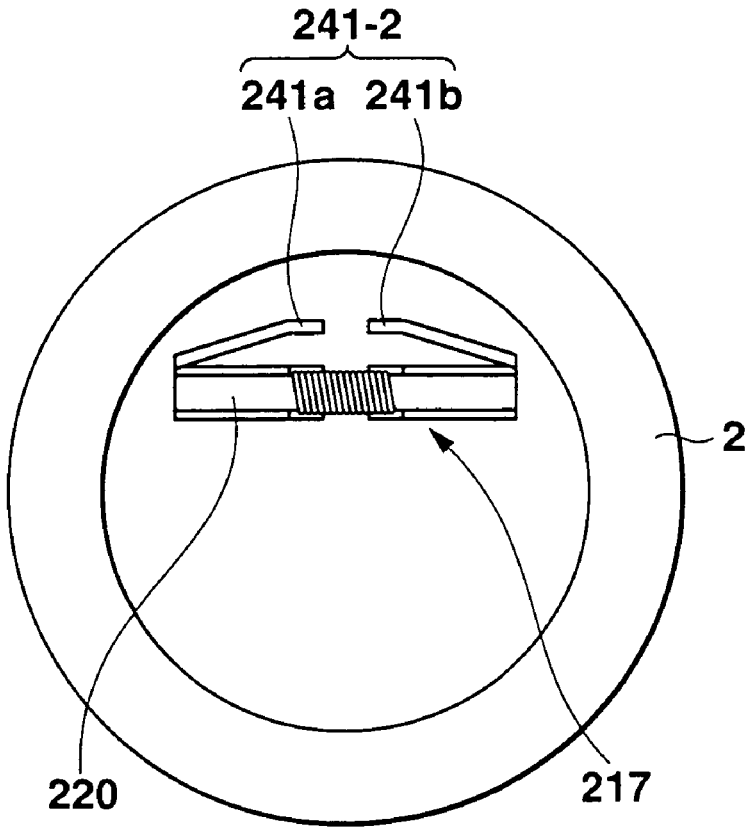
FIG. 30B is a plan view of the wristwatch in FIG. 30A.

The antenna 217 is arranged in the wristwatch as shown in FIGS. 30A and 30B. FIG. 30A is a vertical sectional view of a main portion of the wristwatch storing the antenna 217, and FIG. 30B is a horizontal sectional view of a main portion of the wristwatch.

According to the figures, the antenna 217 is arranged between the back lid 2*c* and the dial 5 so that the axis direction of the core 220 is parallel to the back lid 2*c* (or the dial 5), the magnetic member 241-1 is positioned below the core 220 to face the back lid 2*c*, and the magnetic member 241-2 is positioned on a side of the core 220 to face the inside surface of the watch case 2 closest to the antenna 217. Accordingly, the eddy current loss generated in the back lid 2*c* can be suppressed by the magnetic member 241-1 positioned between the core 220 and the back lid 2*c* and also, the eddy current loss generated in the inside surface of the watch case 2 can be suppressed by the magnetic member 241-2 positioned between the core 220 and the inside surface.

Figure 31A:
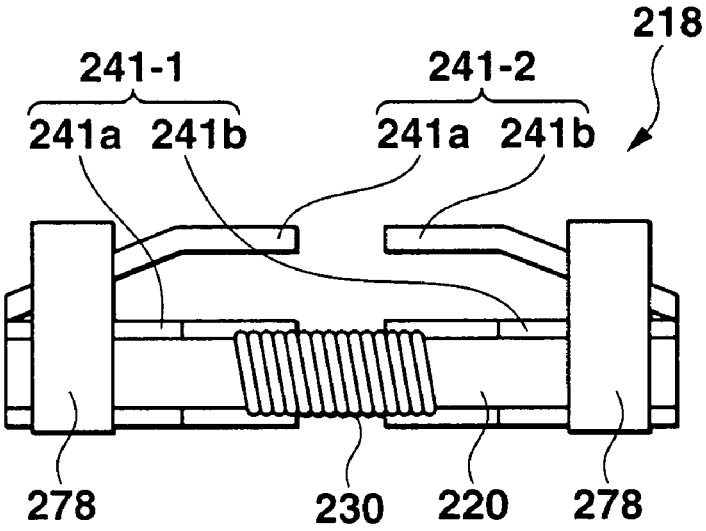
FIGS. 31A to 31C are views showing structures of an antenna having two magnetic members in which the two magnetic members and the core are combined in the second embodiment of the present invention.
Figure 31B:
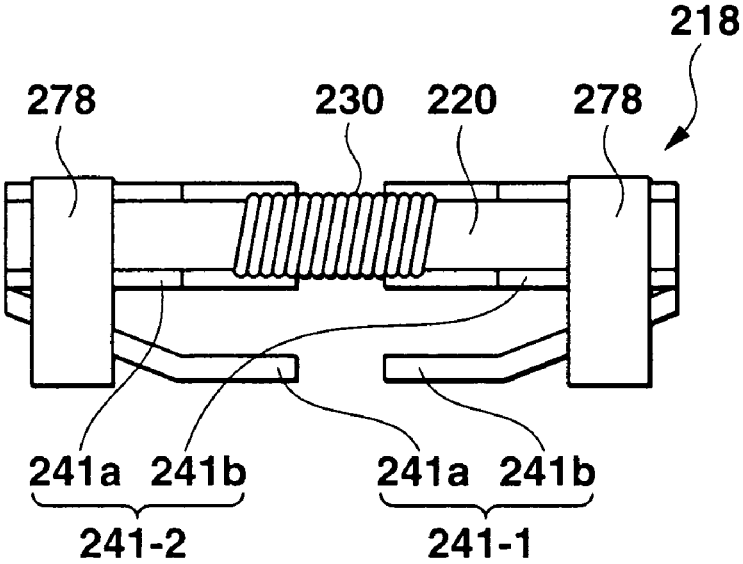
Figure 31C:
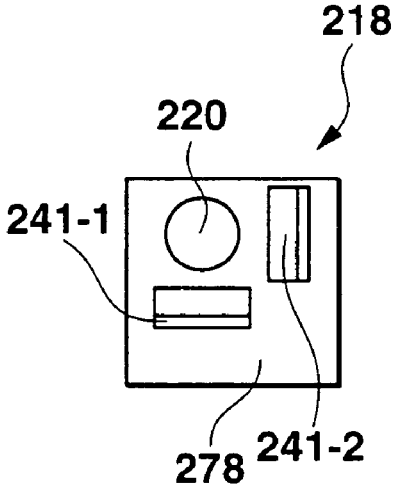

Further, in this case, as shown in FIGS. 31A to 31C, an antenna 218 may be formed so that the two magnetic members 241*a* and 241*b* and the core 220 are fixed as a unit by fixing members 278 formed with an insulating material to keep the arrangement relationship between the above described two magnetic members 241-1 and 241-2 and the core 220. FIG. 31A is a plan view of the antenna 218, FIG. 31B is a front view of the antenna 218, and FIG. 31C is a side view of the antenna 218.

Figure 32A:
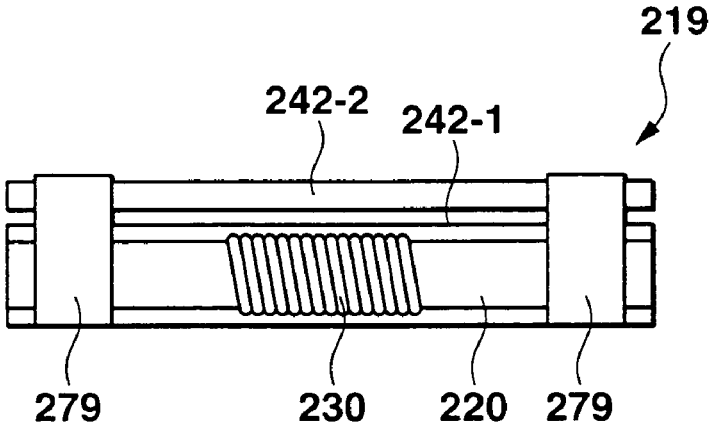
FIGS. 32A to 32C are views showing structures of an antenna having two magnetic members in the third embodiment of the present invention.
Figure 32B:
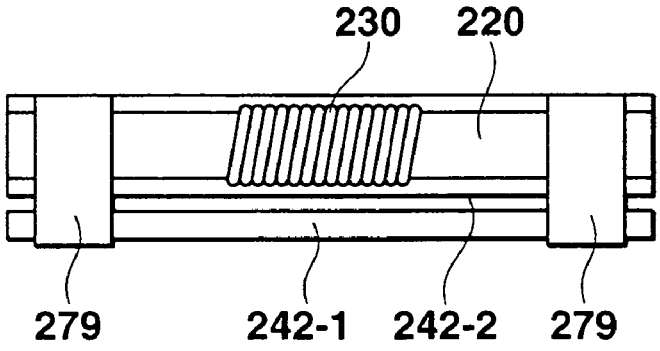
Figure 32C:
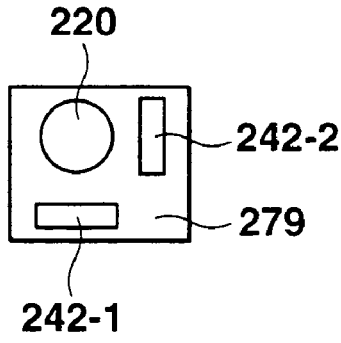

(F-2) In the Case of Arranging a Plurality of Magnetic Members in the Third Embodiment FIGS. 32A to 32C are views showing an antenna 219 comprising two magnetic members 242-1 and 242-2. FIG. 32A is a plan view of the antenna 219, FIG. 32B is a front vie of the antenna 219, and FIG. 32C is a side view of the antenna 219. According to the figures, the antenna 219 comprises the core 220 on which the coil 230 is wound at the middle portion, the two magnetic members 242-1 and 242-2, and fixing members 279. The two magnetic members 242-1 and 242-2 are arranged at an about 90 degrees interval along the circumferential direction of the core 220.

Similar to the above described modified embodiment (F-1), in the wristwatch, the antenna 219 is arranged so that the magnetic member 242-1 is positioned below the core 220 to face the back lid 2*c* and the magnetic member 242-2 is positioned on a side of the core 220 to face the inside surface of the watch case 2 closest to the antenna 219.

(G) Magnetic Member in the Fourth Embodiment

In the above described fourth embodiment, the magnetic member 243 may comprise a plurality of (two or more) magnetic body pieces which face the coil 230 and are separated with one another. The end portion of each of the magnetic body pieces may be bent at one or more points.

(H) Shape of Magnetic Member

Further, in the above described second to fourth embodiments, the magnetic member is formed by bending a plate-shaped body or formed to have a plate shape, however, for example, it may be formed to have a bar-shaped body (the cross sectional shape may be any of a circle, a polygon and the like.).

As seen in the above explanations, the antenna according to the embodiment (for example, the antenna 201 in FIGS. 13A to 13D), comprises:

a bar shaped core (for example, the core 220 in FIGS. 13A to 13D);

a coil which is wound on a middle portion of the core; and a plate shaped magnetic member (for example, the magnetic body 241 in FIGS. 13A to 13D) which is arranged to face the core with a distance thereto along an axis direction of the core, wherein the magnetic member comprises a plurality of magnetic body pieces (for example, the magnetic body pieces 241*a* and 241*b* in FIGS. 13A to 13D) which are separated at a position facing a portion of the core on which the coil is wound.

According to the antenna comprising the structure, the antenna in which the plate shaped magnetic member comprising a plurality of magnetic body pieces which are separated at the position facing the portion of the core on which the coil is wound is arranged to face the core with a space thereto along the axis direction of the core can be realized. In the antenna, the magnetic flux (generated magnetic flux) to oppose the time change of the signal magnetic flux passing through the inside of the coil (magnetic flux generated by the segments of the magnetic field of the radio wave to receive) is generated. At this time, the signal magnetic flux takes the route having a small magnetic resistance. Thus, there is an extremely small amount of signal magnetic flux which passes the portion having a large magnetic resistance where the magnetic body pieces are separated, so that more signal magnetic flux passes through the core. That is, since the signal magnetic flux which passes the coil increases, the receiver sensitivity improves.

In this case, each of the magnetic body pieces may be bent to have a predetermined shape so that a distance between the core and each of the magnetic body pieces is the largest at an end portion of each of the magnetic body pieces facing the portion of the core on which the coil is wound, and becomes small toward the other end portion of each of the magnetic body pieces.

According to the antenna of the embodiment, the antenna in which each of the magnetic body pieces is bent to have a predetermined shape to make the distance between the core and each of the magnetic body pieces be the largest at the end portion of each of the magnetic body pieces facing the portion of the core on which the coil is wound, and becomes small toward the other end portion of each of the magnetic body pieces, can be realized. Accordingly, since the magnetic resistance inside the magnetic member is extremely small compared to that in the air, the signal magnetic flux avoids the route to enter the core from the sides of the end portions of the magnetic body pieces facing the portion of the core on which the coil is wound, and enters the portion of the core on which the coil is not wound from the end portion of the magnetic body piece to pass the core. Consequently, since more signal magnetic flux which passes the coil, the receiver sensitivity improves.

As the antenna according to the embodiment, the antenna may further comprise a coupling member (for example, the coupling member 290 in FIG. 27) to couple the plurality of magnetic body pieces with one another at a portion where the magnetic body pieces are separated.

According to the antenna of the embodiment, since the magnetic resistance inside the coupling member is much larger than that inside the magnetic member, the antenna which can obtain the same effect as the above described antenna can be realized.

As the antenna according to the embodiment, the plurality of magnetic body pieces may be arranged in a circumferential direction of the core.

According to the antenna of the embodiment, the antenna in which the plurality of magnetic body pieces are arranged in the circumferential direction of the core can be realized.

As the antenna according to the embodiment, the antenna may further comprise a fixing member (for example, the fixing member 264 in FIG. 21) to combine the core and the magnetic member.

According to the antenna of the embodiment, the antenna in which the core and the magnetic member are combined by the fixing member can be realized. That is, by fixing the core and the magnetic member, the inductance of the antenna can be kept constant, so that a tuning offset generated by the change of the inductance of the antenna can be prevented. Preferably, the fixing member is formed with an insulating material.

The antenna according to the embodiment (for example, the antenna 203 in FIGS. 19A to 19C), comprises:

a bar shaped core (for example, the core 220 in FIGS. 19A to 19C);

a coil which is wound on a middle portion of the core; and a plate shaped magnetic member (for example, the magnetic member 243 in FIGS. 19A to 19C) which is arranged to face the core with a distance thereto along an axis direction of the core, wherein the magnetic member is formed to have a length in a longitudinal direction smaller than a length of a portion of the core on which the coil is wound.

According to the antenna of the embodiment, the antenna in which the plate shaped magnetic member which is formed to have the length in the longitudinal direction smaller than the length of the portion of the core on which the coil is not wound is arranged to face the core with a distance thereto along the axis direction of the core can be realized. That is, in the surrounding space, the generated magnetic flux is concentrated in the magnetic member at a portion where the magnetic member is arranged to face the core, so that the directivity is sharpened.

In this case, as the antenna according to the embodiment, the antenna may further comprise a fixing member to combine the core and the magnetic member.

According to the antenna of the embodiment, the antenna in which the core and the magnetic member are combined by the fixing member can be realized. That is, by fixing the core and the magnetic member, the inductance of the antenna can be kept constant, so that a tuning offset generated by the change of the inductance of the antenna can be prevented. Preferably, the fixing member is formed with an insulating material.

The antenna according to the embodiment (for example, the antenna 202 in FIGS. 18A to 18D), comprises:

a bar shaped core (for example, the core 220 in FIGS. 18A to 18D);

a coil which is wound on a middle portion of the core;

a plate shaped magnetic member (for example, the magnetic member 242 in FIGS. 18A to 18D) which is arranged to face the core with a distance thereto along an axis direction of the core; and a fixing member (for example, the fixing member 262 in FIGS. 18A to 18D) to combine the core and the magnetic member.

According to the antenna of the embodiment, the antenna in which the plate shaped magnetic member is arranged to face the core with a distance thereto along the axis direction of the core, and the core and the magnetic member are combined by the fixing member, can be realized. In the antenna, the magnetic flux (generated magnetic flux) to oppose the time change of the signal magnetic flux passing through the inside of the coil (magnetic flux generated by the segments of the magnetic field of the radio wave to be received) is generated. At this time, the signal magnetic flux takes the route having a small magnetic resistance. Thus, there is an extremely small amount of signal magnetic flux which passes the portion having a large magnetic resistance where the magnetic body pieces are separated, so that more signal magnetic flux passes through the core. That is, since the signal magnetic flux which passes the coil increases, the receiver sensitivity improves. Moreover, by fixing the core and the magnetic member, the inductance of the antenna can be kept constant, so that a tuning offset generated by the change of the inductance of the antenna can be prevented. Preferably, the fixing member is formed with an insulating material.

The antenna according to the embodiment (for example, the antenna 219 in FIGS. 32A to 32C), comprises:

a bar shaped core (for example, the core 220 in FIG. 32);

a coil which is wound on a middle portion of the core;

a plurality of plate shaped magnetic members (for example, the magnetic member 242 in FIGS. 32A to 32C) which are arranged to face the core with a distance thereto along an axis direction of the core; and a fixing member (for example, the fixing member 279 in FIGS. 32A to 32C) to combine the core and the plurality of magnetic members arranged in a circumferential direction of the core.

According to the antenna of the embodiment, the antenna in which the plurality of plate shaped magnetic members are arranged to face the core with a distance thereto along the axis direction of the core, and the core and the magnetic members are combined by the fixing member, can be realized. In the antenna, the magnetic flux (generated magnetic flux) to oppose the time change of the signal magnetic flux passing through the inside of the coil (magnetic flux generated by the segments of the magnetic field of the radio wave to be received) is generated. At this time, the signal magnetic flux takes the route having a small magnetic resistance. Thus, there is an extremely small amount of signal magnetic flux which passes the portion having a large magnetic resistance where the magnetic body pieces are separated, so that more signal magnetic flux passes through the core. That is, since the signal magnetic flux which passes the coil increases, the receiver sensitivity improves. Moreover, by fixing the core and the magnetic member, the inductance of the antenna can be kept constant, so that a tuning offset generated by the change of the inductance of the antenna can be prevented. Preferably, the fixing member is formed with an insulating material.

Further, the radio watch according to the embodiment (for example, the wristwatch 1 in FIGS. 15 to 19C), comprises:

the antenna shown in FIGS. 15 to 17; and a watch body in which the antenna is arranged.

According to the antenna of the embodiment, specially, in the antenna which is stored in the radio watch, the receiving efficiency (receiver sensitivity) of radio wave can be improved while suppressing the eddy current loss generated in the metal near the back lid or the like formed with metal.

What is claimed is:

1. An antenna comprising:

a bar shaped core;

a coil which is wound on an outer periphery of the core at an intermediate portion of the core;

a magnetic body layer to cover both end portions of the coil and a peripheral portion of the core other than a portion of the core on which the coil is wound, wherein the magnetic body layer comprises two covering parts made of a magnetic material to cover the outer periphery of the coil at respective end portions of the coil; and wherein circular shaped spaces are formed in the two covering parts, such that each of the circular shaped spaces is formed between an inner periphery of one of the two covering parts and the outer periphery of the core, and both end portions of the coil are inserted and arranged inside the circular shaped spaces.

2. The antenna as claimed in claim 1, wherein an outer circumference of a middle portion of the coil is covered with a nonmagnetic material.

3. The antenna as claimed in claim 1, wherein a cut portion is formed in at least one of the covering parts along an axial direction of the core.

4. The antenna as claimed in claim 1, wherein each of the covering parts comprises a facing surface, the respective facing surfaces of the covering parts face each other, and the facing surface of at least one of the covering parts is formed to be inclined with respect to and axial direction of the core.

5. The antenna as claimed in claim 1, wherein the coil is wound on the outer periphery of the core at a middle portion of the core.

* * * * *